US009510089B2

(12) United States Patent
Norris et al.

(10) Patent No.: US 9,510,089 B2
(45) **Date of Patent: *Nov. 29, 2016**

(54) DYNAMIC LOCATION DETERMINATION FOR A DIRECTIONALLY CONTROLLABLE PARAMETRIC EMITTER

(71) Applicant: Turtle Beach Corporation, Poway, CA (US)

(72) Inventors: Elwood Grant Norris, Poway, CA (US); Brian Alan Kappus, San Diego, CA (US); James Arthur Barnes, Las Vegas, NV (US)

(73) Assignee: Turtle Beach Corporation, San Diego, CA (US)

( * ) Notice: Subject to any disclaimer, the term of this patent is extended or adjusted under 35 U.S.C. 154(b) by 78 days.

This patent is subject to a terminal disclaimer.

(21) Appl. No.: 14/519,534

(22) Filed: Oct. 21, 2014

(65) Prior Publication Data

US 2015/0139439 A1 May 21, 2015

Related U.S. Application Data

(60) Provisional application No. 61/893,398, filed on Oct. 21, 2013, provisional application No. 61/893,405, filed on Oct. 21, 2013.

(51) Int. Cl.
*H04R 1/32* (2006.01)
*G10K 11/34* (2006.01)
(Continued)

(52) U.S. Cl.
CPC ..... *H04R 1/323* (2013.01); *G10K 11/346* (2013.01); *H04R 1/403* (2013.01); *H04S 7/303* (2013.01);
(Continued)

(58) Field of Classification Search
CPC H04R 1/323; H04R 1/403; H04R 2201/401; H04R 3/04; H04R 27/00; H04R 2203/12; H04R 3/12; H04R 2217/03; H04R 23/00; H04R 1/026; H04R 5/033; H04R 5/02; H04S 7/303; G10K 11/346; G10K 15/02
USPC ..... 381/77, 80, 92
See application file for complete search history.

(56) References Cited

U.S. PATENT DOCUMENTS

2004/0264707 A1 12/2004 Yang
2005/0057284 A1 3/2005 Wodnicki
(Continued)

FOREIGN PATENT DOCUMENTS

JP 2007266919 10/2007
JP 2012175162 9/2012
(Continued)

OTHER PUBLICATIONS

International Search Report and the Written Opinion for International App No. PCT/US2014/061615, mailed May 27, 2015, Authorized Officer: De Jong, Coen.
(Continued)

*Primary Examiner* — David Ton
(74) *Attorney, Agent, or Firm* — Sheppard Mullin Richter & Hampton LLP

(57) ABSTRACT

An ultrasonic audio system includes a location sensor includes a location tracking module configured to receive information from the location sensor and to determine a location of a listener in a listening environment; a time delay module configured to receive audio content and to generate a plurality of audio content signals, the generated audio content signals comprising a plurality of individual instances of the audio content signal each instance delayed in time relative to the other instances of the audio content signals; and an ultrasonic emitter comprising a plurality of electrically isolated sections, each section having an input electrically coupled to receive one of the individual instances of the audio content signal, and configured to emit an audio-modulated ultrasonic signal from each of the plurality of electrically isolated sections.

26 Claims, 9 Drawing Sheets

(51) Int. Cl.

| | |
|---|---|
| ***H04R 1/40*** | (2006.01) |
| ***H04S 7/00*** | (2006.01) |
| ***H04R 3/04*** | (2006.01) |
| ***H04R 3/12*** | (2006.01) |
| ***H04R 27/00*** | (2006.01) |

(52) U.S. Cl.
CPC . *H04R 3/04* (2013.01); *H04R 3/12* (2013.01); *H04R 27/00* (2013.01); *H04R 2201/401* (2013.01); *H04R 2203/12* (2013.01); *H04R 2217/03* (2013.01)

(56) References Cited

U.S. PATENT DOCUMENTS

| | | | | |
|---|---|---|---|---|
| 2005/0195985 | A1* | 9/2005 | Croft, III | H04R 17/00 381/77 |
| 2005/0207589 | A1 | 9/2005 | Biegelsen | |
| 2005/0207590 | A1 | 9/2005 | Niehoff et al. | |
| 2005/0248233 | A1* | 11/2005 | Pompei | G10K 15/02 310/322 |
| 2006/0145059 | A1* | 7/2006 | Lee | B06B 1/0292 250/214 R |
| 2007/0211574 | A1* | 9/2007 | Croft, III | G10K 15/02 367/197 |
| 2008/0159571 | A1 | 7/2008 | Hooley | |
| 2011/0044467 | A1* | 2/2011 | Pompei | H04R 5/02 381/77 |
| 2011/0060226 | A1 | 3/2011 | Yen et al. | |
| 2012/0299540 | A1 | 11/2012 | Perry | |
| 2015/0092958 | A1* | 4/2015 | Van Tol | H04R 27/00 381/92 |

FOREIGN PATENT DOCUMENTS

| | | |
|---|---|---|
| WO | 2005036921 | 4/2005 |
| WO | 2006005938 | 1/2006 |
| WO | 2007028059 | 3/2007 |
| WO | 2011145030 | 11/2011 |
| WO | 2012122132 | 9/2012 |

OTHER PUBLICATIONS

International Search Report and the Written Opinion for International App No. PCT/US2014/061619, mailed Jan. 22, 2015, Authorized Officer: De Jong, Coen.

Woon-Seng Gan et al.: "Audio Projection", IEEE Signal Processing Magazine, IEEE Service Center, Piscataway, NJ, US, vol. 28, No. 1, Jan. 1, 2011, pp. 43-57, XP011340300, ISSN: 1053-5888.

United States Patent and Trademark Office Action for U.S. Appl. No. 14/519,413, mailed Sep. 28, 2016.

* cited by examiner

DYNAMIC LOCATION DETERMINATION FOR A DIRECTIONALLY CONTROLLABLE PARAMETRIC EMITTER

CROSS-REFERENCE TO RELATED APPLICATIONS

This application claims the benefit of U.S. Patent Application Ser. No. 61/893,398 filed on Oct. 21, 2013, and Ser. No. 61/893,405 filed on Oct. 21, 2013, both of which are hereby incorporated herein by reference in their entirety.

TECHNICAL FIELD

The present disclosure relates generally to parametric emitters for a variety of applications. More particularly, some embodiments relate to location determination systems and methods that can be used with, among other things, a directionally controllable ultrasonic emitter.

BACKGROUND OF THE INVENTION

Non-linear transduction results from the introduction of sufficiently intense, audio-modulated ultrasonic signals into an air column. Self-demodulation, or down-conversion, occurs along the air column resulting in the production of an audible acoustic signal. This process occurs because of the known physical principle that when two sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, an audible sound can be generated by the parametric interaction.

Parametric audio reproduction systems produce sound through the heterodyning of two acoustic signals in a non-linear process that occurs in a medium such as air. The acoustic signals are typically in the ultrasound frequency range. The non-linearity of the medium results in acoustic signals produced by the medium that are the sum and difference of the acoustic signals. Thus, two ultrasound signals that are separated in frequency can result in a difference tone that is within the 60 Hz to 20,000 Hz range of human hearing.

SUMMARY

Embodiments of the technology described herein include systems and methods for providing an ultrasonic audio system, including: a location sensor;

a location tracking module configured to receive information from the location sensor and to determine a location of a listener in a listening environment; a time delay module configured to receive audio content and to generate a plurality of audio content signals, the generated audio content signals including a plurality of individual instances of the audio content signal each instance delayed in time relative to the other instances of the audio content signals; and an ultrasonic emitter including a plurality of electrically isolated sections, each section having an input electrically coupled to receive one of the individual instances of the audio content signal, and configured to emit an audio-modulated ultrasonic signal from each of the plurality of electrically isolated sections. In various embodiments, an amount of delay inserted for each instance of the audio content is computed so that a composite audio-modulated ultrasonic signal emitted by the emitter is directed toward the determined location of the listener.

The location tracking module may further be configured to track the location of the listener as the listener moves about in the listening environment, and the time delay module may further be configured to adjust the relative delays of the instances of the audio content signal so that the composite audio-modulated ultrasonic signal emitted by the emitter is directed toward the listener as the listener moves about the listening environment.

The sensor may include an identification-specific sensor and the location tracking module may be configured to track the location of a specific identified listener such that the composite audio-modulated ultrasonic signal emitted by the emitter can be directed toward the identified listener as the specific identified listener as that specific identified listener moves about the listening environment. The identification-specific sensor may include at least one of an RFID tag, a barcode, an optical identifier, and a facial recognition sensor.

The sensor may include an identification-specific sensor and the ultrasonic audio system may be configured to emit an ultrasonic audio signal only upon the detection of the specified listener. The may include an identification-specific sensor and the location tracking module may be configured to track the location of a plurality of identified listeners, and wherein the ultrasonic audio system may be configured to receive a plurality of different audio content streams and to interleave the plurality of different audio content streams into a multiplexed signal, and the time delay module may be configured to generate individual instances of the audio content signal for each audio content stream, such that the audio content corresponding to each audio content stream can be delivered to its intended listener.

The location sensor may include a plurality of location sensors, and the location sensor may include at least one of an infrared sensor, optical sensor, sonic sensor, ultrasonic sensor, RF sensor, GPS location detector and pressure sensor.

The ultrasonic audio system may also include an audio processing module configured to receive the audio content from an audio source and to process the audio content for delivery by way of an ultrasonic carrier and a modulator configured to modulate the received audio content onto an ultrasonic carrier.

The ultrasonic emitter may include a conductive backplate, a conductive emitting surface, and an insulting layer disposed between the conductive backplate and the conductive emitting surface, and further wherein the conductive emitting surface may include a plurality of conductive sections separated by insulating sections interposed between the conductive sections.

The time delay differences between the plurality of individual instances of the audio content may be chosen to steer the audio-modulated ultrasonic signal emitted by the emitter in a predetermined direction relative to a face of the emitter. Additionally, the time delay differences between the plurality of individual instances of the audio content may be chosen to focus the audio-modulated ultrasonic signal emitted by the emitter at a distance from a face of the emitter. In some embodiments, the time delay differences between the plurality of individual instances of the audio content may be chosen to control a distance from the emitter at which sound is produced by the audio-modulated ultrasonic signal.

The electrically isolated sections of the emitter may be arranged horizontally across the emitter or as a matrix on a face of the emitter. The emitter may also include a plurality of selectable interconnects, selectively electrically connecting adjacent pairs of the electrically isolated sections. A control module may be included to control the selectable interconnects to selectively connect one or more adjacent pairs of the electrically isolated sections of the emitter. The control module may be configured to control a direction in which an ultrasonic beam can be steered by the emitter by selectively connecting determined adjacent pairs of the electrically isolated sections of the emitter to create a plurality of combined emitter sections. A switching matrix may be included and configured to selectively route individual ones of the audio content signals to selected groups of electrically isolated sections.

In other embodiments, An ultrasonic audio system, may include: a location sensor; a location tracking module configured to receive information from the location sensor and to determine respective locations of a plurality of listeners detected by the location sensor; a time delay module configured to receive audio content and to generate a plurality of audio content signals, the generated plurality of audio content signals each including a plurality of individual instances of the audio content signal each instance delayed in time relative to the other instances of its respective audio content signal; an ultrasonic emitter including a plurality of electrically isolated sections, each section having an input electrically coupled to receive one of the individual instances of the audio content signal, and configured to emit an audio-modulated ultrasonic signal from each of the plurality of electrically isolated sections; wherein an amount of delay inserted for the instances of the audio content for each of the generated plurality of audio content signals is computed so that a composite audio-modulated ultrasonic signal emitted by the emitter for each of the generated plurality of audio content signals is directed toward the determined location of respective listener corresponding to that generated audio content signal; and a multiplexer configured to multiplex the generated plurality of audio content signals prior to delivery to the ultrasonic emitter.

The location tracking module may be further configured to track the location of each of the plurality of listeners as the listeners move about in the listening environment, and the time delay module is further configured to adjust the relative delays of the instances of the audio content signal for each listener based on changes in listener positions in the listening environment.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the accompanying figures. The drawings are provided for purposes of illustration only and merely depict typical or example embodiments of the invention. These drawings are provided to facilitate the reader's understanding of the systems and methods described herein, and shall not be considered limiting of the breadth, scope, or applicability of the claimed invention.

Some of the figures included herein illustrate various embodiments of the invention from different viewing angles. Although the accompanying descriptive text may refer to elements depicted therein as being on the "top," "bottom" or "side" of an apparatus, such references are merely descriptive and do not imply or require that the invention be implemented or used in a particular spatial orientation unless explicitly stated otherwise.

FIG. 6, which comprises

The figures are not intended to be exhaustive or to limit the invention to the precise form disclosed. It should be understood that the invention can be practiced with modification and alteration, and that the invention be limited only by the claims and the equivalents thereof.

DESCRIPTION

Embodiments of the systems and methods described herein provide a HyperSonic Sound (HSS) audio system or other ultrasonic audio system for a variety of different applications. Certain embodiments provide a thin film ultrasonic emitter for ultrasonic carrier audio applications.

Figure 1:
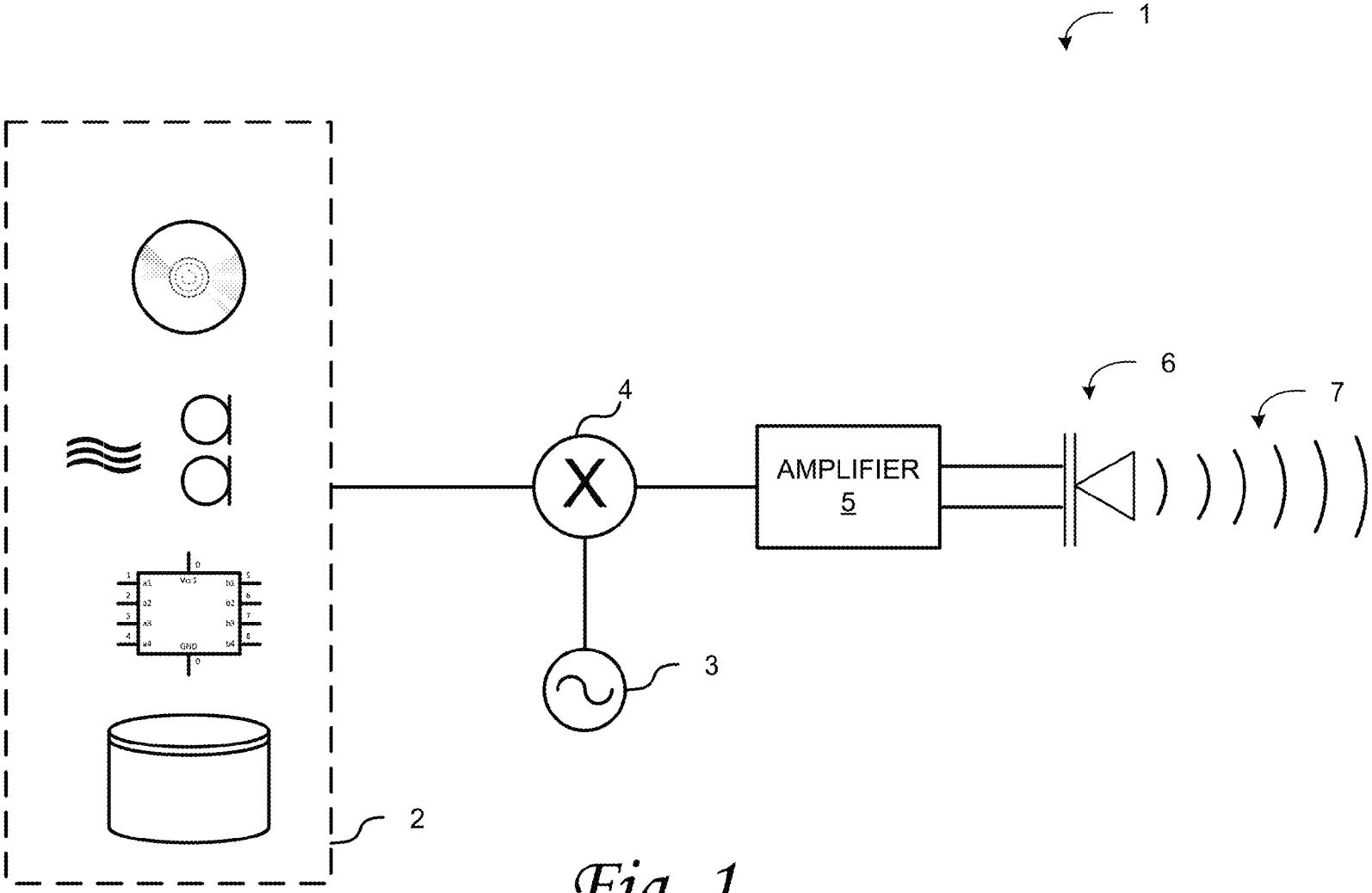
FIG. 1 is a diagram illustrating an ultrasonic sound system suitable for use with the emitter technology described herein.

FIG. 1 is a diagram illustrating an ultrasonic sound system suitable for use in conjunction with the systems and methods described herein. In this exemplary ultrasonic system 1, audio content from an audio source 2, such as, for example, a microphone, memory, a data storage device, streaming media source, MP3, CD, DVD, set-top-box, or other audio source is received. The audio content may be decoded and converted from digital to analog form, depending on the source. The audio content received by the audio system 1 is modulated onto an ultrasonic carrier of frequency f1, using a modulator. The modulator typically includes a local oscillator 3 to generate the ultrasonic carrier signal, and multiplier 4 to modulate the audio signal on the carrier signal. The resultant signal is a double- or single-sideband signal with a carrier at frequency f1 and one or more side lobes. In some embodiments, the signal is a parametric ultrasonic wave or a HSS signal. In most cases, the modulation scheme used is amplitude modulation, or AM, although other modulation schemes can be used as well. Amplitude modulation can be achieved by multiplying the ultrasonic carrier by the information-carrying signal, which in this case is the audio signal. The spectrum of the modulated signal can have two sidebands, an upper and a lower side band, which are symmetric with respect to the carrier frequency, and the carrier itself.

The modulated ultrasonic signal is provided to the transducer 6, which launches the ultrasonic signal into the air creating ultrasonic wave 7. When played back through the transducer at a sufficiently high sound pressure level, due to nonlinear behavior of the air through which it is 'played' or transmitted, the carrier in the signal mixes with the sideband(s) to demodulate the signal and reproduce the audio content. This is sometimes referred to as self-demodulation. Thus, even for single-sideband implementations, the carrier is included with the launched signal so that self-demodulation can take place.

Although the system illustrated in FIG. 1 uses a single transducer to launch a single channel of audio content, one of ordinary skill in the art after reading this description will understand how multiple mixers, amplifiers and transducers can be used to transmit multiple channels of audio using ultrasonic carriers. The ultrasonic transducers can be mounted in any desired location depending on the application.

Figure 2:
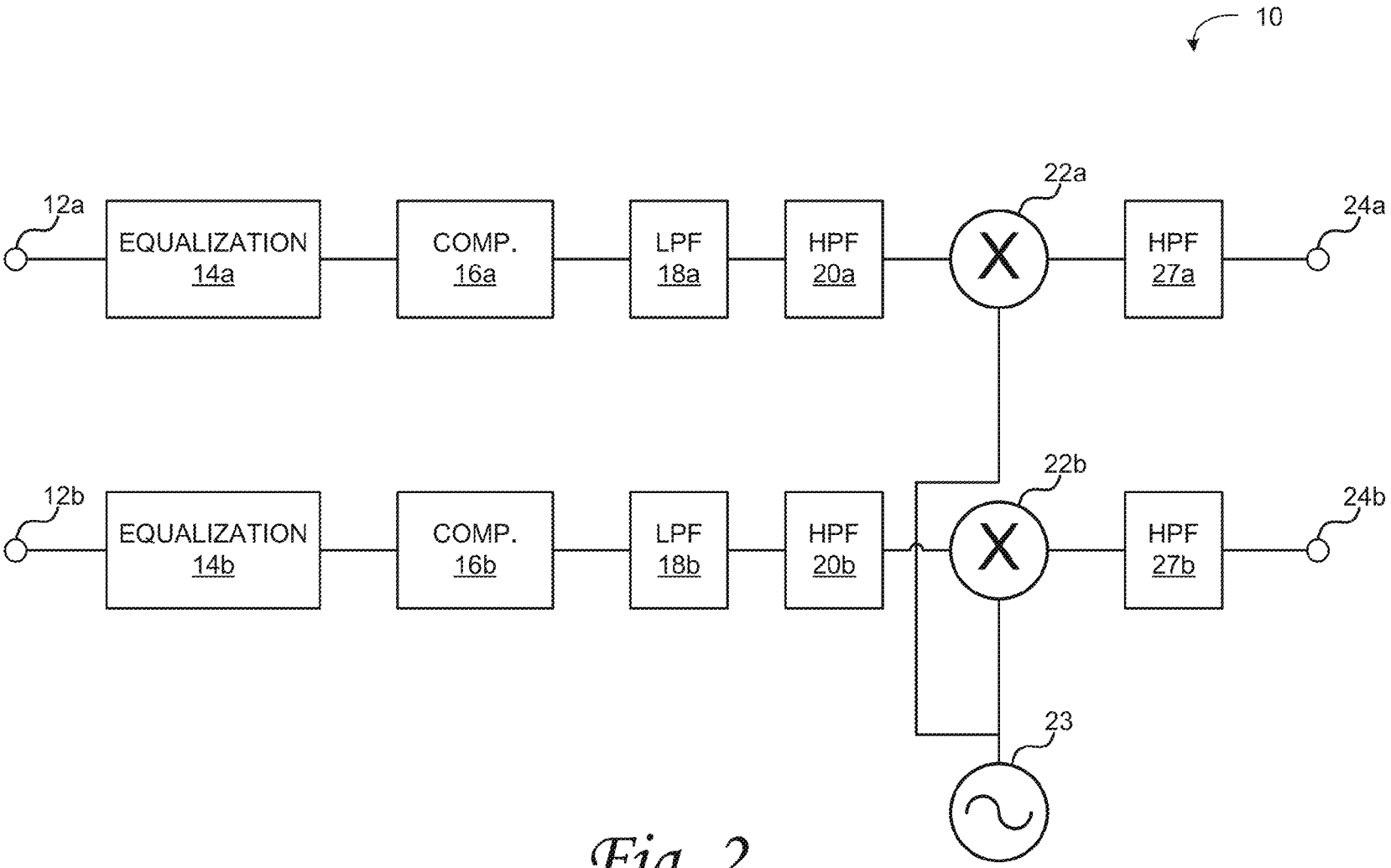
FIG. 2 is a diagram illustrating another example of a signal processing system that is suitable for use with the emitter technology described herein.

One example of a signal processing system 10 that is suitable for use with the technology described herein is illustrated schematically in FIG. 2. In this embodiment, various processing circuits or components are illustrated in the order (relative to the processing path of the signal) in which they are arranged according to one implementation. It is to be understood that the components of the processing circuit can vary, as can the order in which the input signal is processed by each circuit or component. Also, depending upon the embodiment, the processing system 10 can include more or fewer components or circuits than those shown.

Also, the example shown in FIG. 1 is optimized for use in processing two input and output channels (e.g., a "stereo" signal), with various components or circuits including substantially matching components for each channel of the signal. It will be understood by one of ordinary skill in the art after reading this description that the audio system can be implemented using a single channel (e.g., a "monaural" or "mono" signal), two channels (as illustrated in FIG. 2), or a greater number of channels.

Referring now to FIG. 2, the example signal processing system 10 can include audio inputs that can correspond to left 12*a* and right 12*b* channels of an audio input signal. Equalizing networks 14*a*, 14*b* can be included to provide equalization of the signal. The equalization networks can, for example, boost or suppress predetermined frequencies or frequency ranges to increase the benefit provided naturally by the emitter/inductor combination of the parametric emitter assembly.

After the audio signals are equalized compressor circuits 16*a*, 16*b* can be included to compress the dynamic range of the incoming signal, effectively raising the amplitude of certain portions of the incoming signals and lowering the amplitude of certain other portions of the incoming signals. More particularly, compressor circuits 16*a*, 16*b* can be included to narrow the range of audio amplitudes. In one aspect, the compressors lessen the peak-to-peak amplitude of the input signals by a ratio of not less than about 2:1. Adjusting the input signals to a narrower range of amplitude can be done to minimize distortion, which is characteristic of the limited dynamic range of this class of modulation systems. In other embodiments, the equalizing networks 14*a*, 14*b* can be provided after compressors 16*a*, 16*b*, to equalize the signals after compression.

Low pass filter circuits 18*a*, 18*b* can be included to provide a cutoff of high portions of the signal, and high pass filter circuits 20*a*, 20*b* providing a cutoff of low portions of the audio signals. In one exemplary embodiment, low pass filters 18*a*, 18*b* are used to cut signals higher than about 15-20 kHz, and high pass filters 20*a*, 20*b* are used to cut signals lower than about 20-200 Hz.

The high pass filters 20*a*, 20*b* can be configured to eliminate low frequencies that, after modulation, would result in deviation of carrier frequency (e.g., those portions of the modulated signal of FIG. 6 that are closest to the carrier frequency). Also, some low frequencies are difficult for the system to reproduce efficiently and as a result, much energy can be wasted trying to reproduce these frequencies. Therefore, high pass filters 20*a*, 20*b* can be configured to cut out these frequencies.

The low pass filters 18*a*, 18*b* can be configured to eliminate higher frequencies that, after modulation, could result in the creation of an audible beat signal with the carrier. By way of example, if a low pass filter cuts frequencies above 15 kHz, and the carrier frequency is approximately 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is within the range of human hearing.

In the example system 10, after passing through the low pass and high pass filters, the audio signals are modulated by modulators 22*a*, 22*b*. Modulators 22*a*, 22*b*, mix or combine the audio signals with a carrier signal generated by oscillator 23. For example, in some embodiments a single oscillator (which in one embodiment is driven at a selected frequency of 40 kHz to 50 kHz, which range corresponds to readily available crystals that can be used in the oscillator) is used to drive both modulators 22*a*, 22*b*. By utilizing a single oscillator for multiple modulators, an identical carrier frequency is provided to multiple channels being output at 24*a*, 24*b* from the modulators. Using the same carrier frequency for each channel lessens the risk that any audible beat frequencies may occur.

High-pass filters 27*a*, 27*b* can also be included after the modulation stage. High-pass filters 27*a*, 27*b* can be used to pass the modulated ultrasonic carrier signal and ensure that no audio frequencies enter the amplifier via outputs 24*a*, 24*b*. Accordingly, in some embodiments, high-pass filters 27*a*, 27*b* can be configured to filter out signals below about 25 kHz.

Additional examples of ultrasonic audio systems, including parametric transducers and drivers, with which the technology disclosed herein may be implemented are disclosed in U.S. Pat. No. 8,718,297, titled Parametric Transducer and Related Methods, which is incorporated herein by reference in its entirety.

In accordance with various embodiments of the systems and methods described herein an ultrasonic emitter, whether electrostatic, piezo, or otherwise, can be configured with a plurality of discrete regions (sometimes referred to as segments or sections) such that different audio-modulated ultrasonic signals can be delivered to different regions of the emitter. In various embodiments, the discrete regions can be electrically isolated from one another such that the ultrasonic emitter is effectively comprised of a plurality of electrically separate ultrasonic emitters. Such regions can also be mechanically isolated from one another. Such a configuration can be useful for a number of applications. For example, because of the directional nature of ultrasonic audio, a segmented emitter with a plurality of electrically isolated segments can be used in conjunction with the appropriate drive modules to control the directionality of the emitted audio-modulated ultrasonic signal electrically, without the need to reposition or reorient the emitter itself physically.

Accordingly, one example application is to deliver time-shifted versions of the same audio-modulated ultrasonic signal to each of the separate segments of the ultrasonic emitter to adjust the directionality of the emitted ultrasonic signal. The relative time delays among the various signals provided to the emitter segments can be controlled to control the directionality of the ultrasonic emitter. In further embodiments, listener location detection can be employed to determine a location of an intended listener relative to the emitter, and this can be coupled to the beam steering mechanism such that the system can track an intended listener and steer the emitted ultrasonic signal toward the listener as he or she moves about in a listening area. Any of a number of location mechanisms can be used to determine the position of the listener relative to the ultrasonic emitter, examples of which are described below. In addition to or in place of steering the beam through time delay, in some embodiments the ultrasonic beam can be corrected by changing the position or orientation of the location sensor, and the beam can be dispersed to provide a wider listening area.

Such a system can be implemented to achieve a number of effects such as, for example, steering the beam in the direction of an intended listener (e.g., steering the beam to a fixed location, steering the beam as a listener moves about the listening area, etc.), and increasing the signal strength of the emitted signal in a desired direction (e.g., focusing the beam to a point or confined area). These techniques can be used to, for example, target a desired listener (e.g., an individual listener or a group of listeners) in a particular location relative to the emitter, and maintain audio privacy in areas outside of the area targeted by the emitter.

As another example, in some embodiments a directionally controllable emitter can be used to direct each of a plurality of different sources of audio content to its corresponding intended listeners or listening locations. For example, audio content from different sources can be interleaved in time (or otherwise multiplexed) into a single audio stream, and the directionality of the emitter adjusted at each time interval to direct the audio from each source to its intended listening location. Time stamps, markers or other like semaphores can be used (whether in digital or analog implementations) can be used to mark the beginning and end of the time intervals for each audio source. For example, in digital implementations the data can be interleaved into frames, packets or other data units with appropriate identifiers for each source. In further embodiments, information can be included in the packets to identify a desired direction or location for beam steering for the data in a given packet. Because relatively short delays in delivered audio are typically imperceptible to the human ear, a plurality of audio sources can be delivered to the emitter and the emitter can take samples from each source, one at a time, and adjust the segment delays for each audio source sample to create signal-sets for source (e.g., original and delayed signals). When played to the emitter, the signal-sets with the built-in delays, cause their corresponding audio content to the intended listening location for each source.

Figure 3:
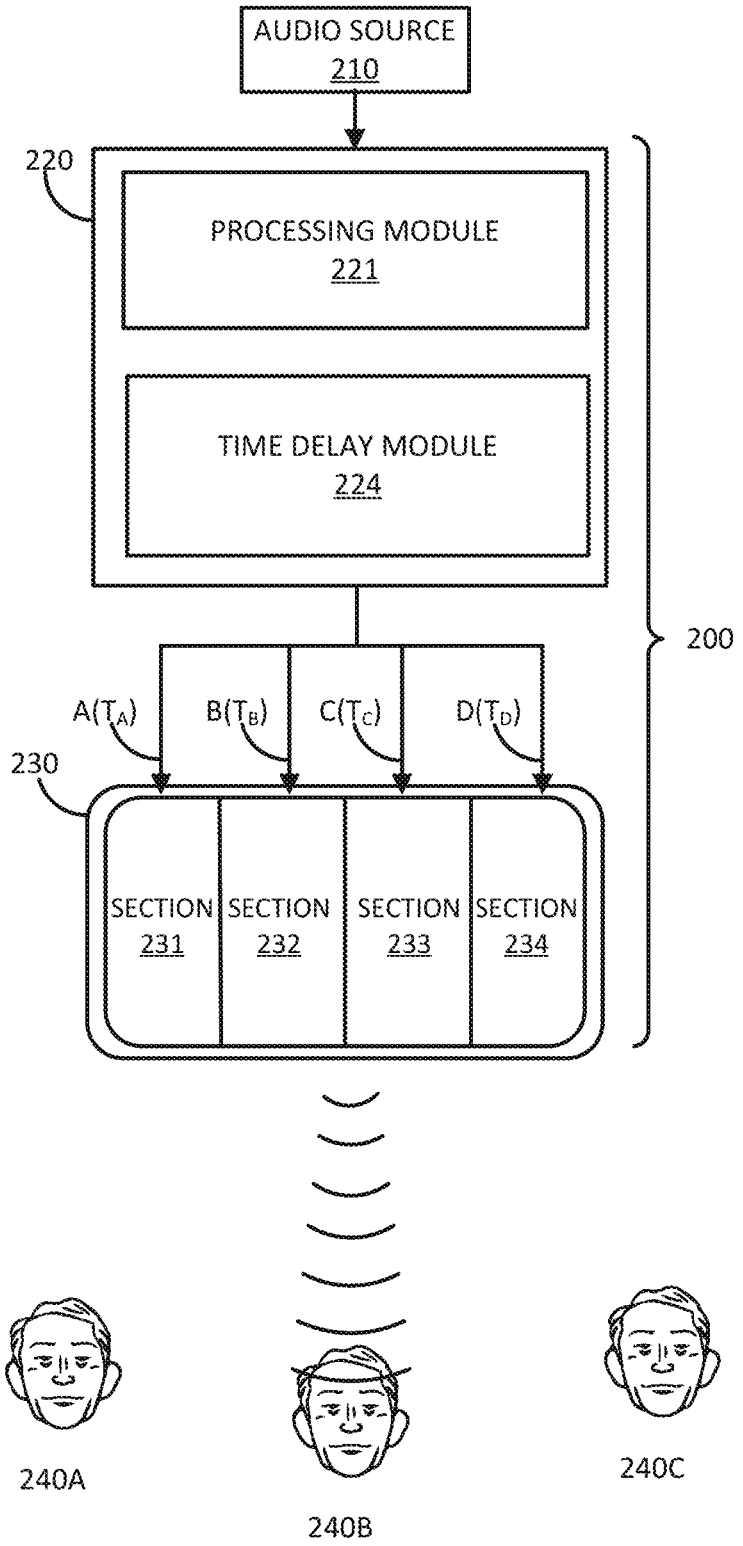
FIG. 3 is a diagram illustrating an example ultrasonic emitter system utilizing a segmented ultrasonic emitter for directional control in accordance with one embodiment of the technology described herein.

FIG. 3 is a diagram illustrating an example ultrasonic emitter system utilizing a segmented ultrasonic emitter for directional control in accordance with one embodiment of the technology described herein. As shown in the example illustrated in FIG. 3, the system includes an audio source 210, an audio receiver/processor 220, and an ultrasonic emitter 230. Audio source 210 can comprise any of a number of different audio sources to provide the audio content for the system. For example, audio source 210 can include audio sources 2 as shown in and described with respect to FIG. 1, above.

The ultrasonic emitter 230 shown in the example of FIG. 3 includes four sections or electrically separate or isolated segments 231, 232, 233, and 234. The electrically separate or isolated segments 231, 232, 233, and 234 can comprise conductive sections separated by an insulating region to isolate the sections from one another electrically. Although four separate sections are illustrated, an ultrasonic emitter in accordance with the teachings described herein can be implemented using any of a number of electrically separate or isolated sections. Likewise, physically separate emitters can be used. The emitter is implemented in accordance with the teachings described herein can be implemented as electrostatic emitters, similar to those described above, but arranged with separate segments to provide the capability to emit individuals signals from each segment. Alternatively, any segmented ultrasonic emitter can be used. For example, piezo transducers can also be configured with separate transducing sections and used as emitters in accordance with the teachings contained herein.

In the illustrated example, audio receiver/processor module 220 includes an audio processing module 221, and a time delay module 224. Audio processing module 221 can comprise any of a number of configurations of audio processing and modulation systems including, for example, the system shown in and described with reference to FIGS. 1 and 2. In this regard, audio processing module 221 may be configured to receive audio content from audio source 210 (e.g. audio sources 2 of FIG. 2) to generate audio-modulated ultrasonic carrier signals for delivery to an ultrasonic emitter 230.

As shown in the example of FIG. 3, a time delay module can be included to insert a relative delay into the audio-modulated ultrasonic signals that are delivered to each of the emitter segments or sections 231, 232, 233 and 234. Particularly, time delay module 224 can be implemented to provide a modulated ultrasonic signal to a first segment of the emitter, and provide time-shifted versions of the same modulated ultrasonic signal to each of the adjacent segments of the emitter such that the fields of the ultrasonic signals emitted from each segment add constructively in the desired direction of emission. This can be accomplished by inserting a predetermined time delay in line with the emitter segments. For example, depending on the direction in which the beam is to be steered, the time delay for one segment can be set at zero (e.g., no additional time delay inserted) or some other initial delay value, and the signals to each of the other segments can be subjected to an additional amount of delay, which amount is increased from one segment to the next. In the notation used in FIG. 3, four signals, A, B, C, and D are created. Each signal is delayed by its respective time to yield the desired directionality. In this example, the delays are denoted by $T_A$, $T_B$, $T_C$, and $T_D$.

As a further example, consider a scenario in which audio is intended to be directed toward listener 240C. In this scenario, the modulated ultrasonic signal is provided to segment 231 with an initial delay of $d_0$. Initial delay $d_0$ can be a zero delay (no additional delay injected) or some other non-zero quantity. Time-delayed versions of the same modulated ultrasonic signal are provided to each of the adjacent segments of the emitter 232, 233, 234 with increasing amounts of delay such that the fields of the ultrasonic signals emitted from each segment add constructively in the direction of listener 240C.

In various embodiments, the up conversion or modulation of the audio content onto an ultrasonic carrier can be performed before or after the time delay. In one embodiment, the audio content is processed (e.g., equalization, compression, etc.) and modulated onto an ultrasonic carrier at a predetermined carrier frequency. The audio-modulated ultrasonic signal is then time delayed and the modulated signals with relative time shifts are provided to their respective corresponding antenna segments as described above and shown in FIG. 3. In another embodiment, the signal is time delayed first and then modulated on to ultrasonic carriers to provide the time delayed signals for the segments.

The directionally controllable ultrasonic emitter 230 may be utilized in ultrasonic emitter systems, such as, for example, system I of FIG. 1 (e.g., as emitter 6). Moreover, as mentioned above, the directionally controllable ultrasonic emitter can be implemented utilizing the electrostatic emitters described above. In such examples, the conductive surfaces of the emitter, for example, the outer-facing conductive surfaces of the emitter, may comprise two or more emitter sections electrically isolated from one another such that each can be driven with a modulated ultrasonic signal that is time delayed relative to its adjacent segment(s). Preferably, the sections are also mechanically isolated such that ultrasonic vibrations on one segment do not travel to and interfere with ultrasonic vibrations on adjacent segments (or they are sufficiently isolated such that such interference is reduced to acceptable levels for the desired level of audio quality and directionality).

As a further example, in an electrostatic emitter having to conductive layers separated by an insulating layer, one or both of the conductive layers can be segmented into a plurality of electrically isolated sections to provide a plurality of separate emitter sections. In various embodiments, neither the intermediate insulating layer nor a backing plate needs to be segmented in order to provide a directionally controllable emitter. In various embodiments, a common return signal can be used for each of the time-adjusted signals and this common return can be connected through, for example, a non-segmented one of the 2 conductive layers. In various embodiments or applications, it may be desirable to mechanically separate or isolate the insulating layer as well to avoid vibrational interference between or among the segments. In some embodiments, an air gap can be used as the insulating layer.

Although the exemplary emitter sections 231, 232, 233, 234 are illustrated as part of a single physical structure (e.g., a single directionally controllable ultrasonic emitter), the present disclosure is not limited in this way. For example, any of the two or more emitter sections (e.g., emitter section 231, 232, 233, 234) may be located in separate emitter structures and/or may be controlled through control logic (e.g., an audio receiver/processor 220*a* or 220*b*) so as to achieve the directional control consistent with the present disclosure. Although the exemplary emitter sections 231, 232, 233, 234 are illustrated as arranged vertically, the present disclosure is not limited in this way. A directionally controllable ultrasonic emitter may include one or more emitter sections. The emitter sections may be arranged vertically, horizontally, diagonal and/or in another spatial configuration that is consistent with the present disclosure. For example, the number, the alignment and/or the spatial configuration of the emitter sections may be chosen to achieve a desired directionally effect, such as for example, steering of the emitter signal, or any part thereof, in a particular direction (e.g., up, down, left right). Furthermore, the signal, or any part thereof, may be steered at the same and/or different times. It is to be understood that the number of and the a number, the alignment and/or the spatial configuration of the emitter sections may be chosen so as to allow constructive and/or destructive interference of signals generated by different emitter sections that may be delayed relative to the other signals generated by the same time and/or different emitter sections.

The directionally controllable emitter can be implemented using any number of a plurality of segments, and the four sections 231, 232, 233, 234 shown in the figures herein have been selected for illustrative purposes only. After reading this description, it will become apparent to one of ordinary skill in the art that the directionally controllable ultrasonic emitter 230 may comprise any number of emitter sections (e.g., two or more). Each of the emitter sections (e.g., emitter section 231, 232, 233, 234) may be operable to generate ultrasonic outputs of particular characteristics.

In various embodiments, a larger number of small segments may provide better steering. The width of the segments is preferably small relative to the wavelength of the ultrasonic carrier. In some embodiments, the upper limit for segment width can be approximately three times the wavelength of the carrier. For example, for a carrier frequency of 90 MHz, an upper limit for the width of the segments can be approximately 1 cm. For an emitter that is about 30 cm wide, that would equate to approximately 30 strips. Because each segment is driven with a different signal (difference based on delay), in various embodiments each segment uses a dedicated amplifier. Thus, as the number of segments increases so does the cost associated with the larger number of amplifiers required. However, as the size of the segments decreases, so do its power requirements. In some embodiments, the segments are small enough such that they may be driven by relatively low-cost, low-power components such as, for example, op amps. Thus, while a greater number of segments may result in more amplifiers, the individual amplifiers themselves may become lower power, less complex and less costly.

In the illustrated example, the emitter is segmented horizontally, which can be used with time delayed signals to steer the ultrasonic emissions from left to right (or vice versa). Segmentation orientations other than horizontal can be used in various embodiments. For example, the emitter can be segmented vertically to allow steering of the ultrasonic signal up or down relative to the emitter. As these examples illustrate, the various geometries or orientations of segmentation can be provided. For example, diagonal segmentation can be used to provide steering diagonally relative to the emitter. Regardless of the segmentation orientation, in various embodiments a segmented emitter can be mounted in different orientations to select, for example, left/right or up/down steering.

As yet a further example, the emitter sections can be segmented in a matrix fashion providing a plurality of rows and columns of emitter segments. Switching mechanisms can also be provided to electrically connect the segments in rows or columns to allow electronic control of the segmentation. For example, each row of segments can be electrically connected via a switching mechanism to provide a row-wise segmented emitter. Similarly, each column of segments can be electrically connected via switching to provide a column wise (e.g., left/right) segmented emitter.

Figure 4:
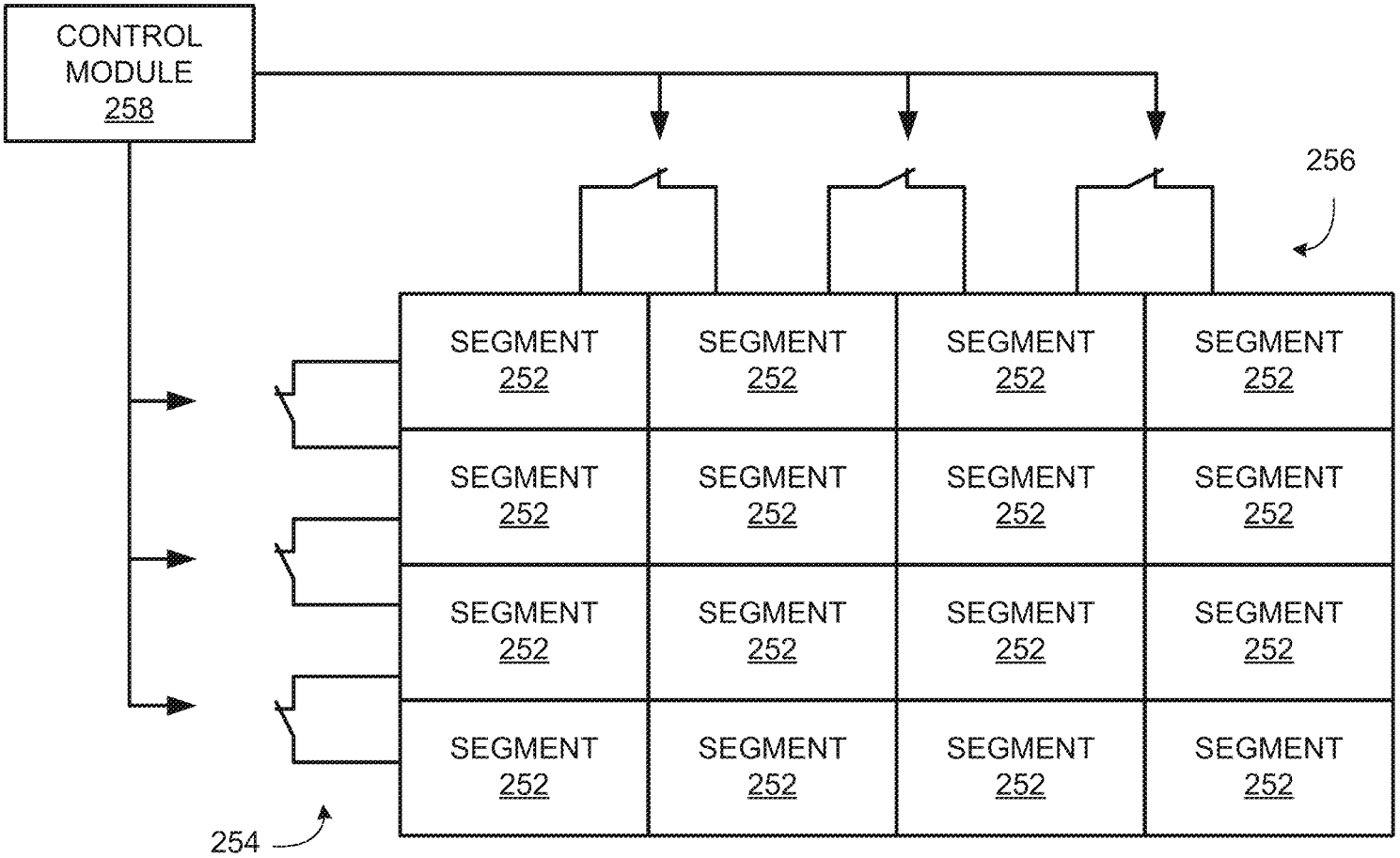
FIG. 4 is a diagram illustrating an example of an ultrasonic emitter segmented in a matrix fashion to allow configurability of the beam steering direction (e.g. left/right or up/down) in accordance with one embodiment of the technology described herein.

FIG. 4 is a diagram illustrating an example of an ultrasonic emitter segmented in a matrix fashion to allow configurability of the beam steering direction (e.g. left/right or up/down) in accordance with one embodiment of the technology described herein. As shown in this example, the emitter includes a plurality of segments 252 arranged in rows and columns. Although the illustrated example is a 4×4 matrix with 16 segments 252, other quantities of segments can be provided in the rows or columns, and the matrix need not be a square matrix. Furthermore, the matrix need not have rows and columns in which the segments are in line with one another as illustrated, but instead, the segments can be offset in rows or columns to create alternative patterns and alternative possibilities for being steering. Still further, the segments can be all the same size or substantially the same size, or other sizes can vary from segment to segment.

The example of FIG. 4 also shows a plurality of selectable interconnects 254 that can be used to electrically connect the leftmost column of segments, forming a combined emitter segment. Similar selectable interconnects can be provided for each column to create a plurality of combined emitter segments (e.g. a plurality of columnar sections) but are not shown to maintain clarity in the drawing. This example also shows a plurality of selectable interconnects 256 that can be used to electrically connect the topmost row of segments, forming a combined emitter segment. Similar selectable interconnects can be provided for each row to create a plurality of combined emitter segments (e.g. a plurality of row-wise sections), but again are not shown to maintain clarity in the drawing. Selectable interconnects can be implemented using switches or other selective electrical couplings can be implemented using mechanical switches or relays, solid state switches (e.g., FETs, solid state relays, thyristors, etc.), and so on.

Control module 258 can be provided to control the switches. Closing one bank of selectable interconnects electrically connects its corresponding segments creating an effective single segment. Closing the selectable interconnects for each column effectively creates a horizontally segmented emitter as shown in FIG. 3. Alternatively, closing the selectable interconnects for each row would effectively create a vertically segmented emitter. As this example serves to illustrate, providing additional switches for alternative configurations of switches can enable control of effective segmentation of the emitter electronically as desired. Including switches that enable connecting the segments diagonally, for example, can be implemented to allow directional control of the signal in both a left/right and up/down direction. However, because diagonal connections may yield a smaller surface area of used emitter segments, the sound volume of the delivered audio content may be lesser in such configurations. In some embodiments, the control module can be configured to calculate the effective surface area of the emitter based on the switching and adjust the signal strength or attenuation accordingly.

Where multiple segments 252 are connected via the selectable interconnects, these particular segments are no longer electrically isolated from one another. That is, they can have the same electric potential. Therefore, a signal such as an audio-modulated ultrasonic signal electrically connected to one of the segments can be emitted by each of the segments at the same time. That is, the combined segments form a combined emitter section emitting an ultrasonic signal electrically connected to one or more of the segments in the combination.

In other embodiments, rather than electrically connecting determined segments using selectable interconnects to electrically connect the segments, signal control or switching mechanisms can be used to selectively direct the time delayed ultrasonic signals to desired segments. For example, a switching matrix can be provided to allow each of the audio-modulated ultrasonic signals at different delays to be delivered to a selected combination of emitter segments. As a further example, to create a columnar sectioned emitter as shown in the example of FIG. 3 by combining segments, the four signals, A, B, C, and D can be created, with each signal delayed by it respective time to yield the desired directionality. Signal $A(T_A)$ (from the example of FIG. 3) can be delivered to each of the segments 252 in the leftmost column, signal $B(T_B)$ can be delivered to each of the segments 252 in the second column from the left, signal $C(T_C)$ can be delivered to each of the segments 252 in the second column from the right, and signal $D(T_D)$ can be delivered to each of the segments 252 in the rightmost column.

Figure 5:
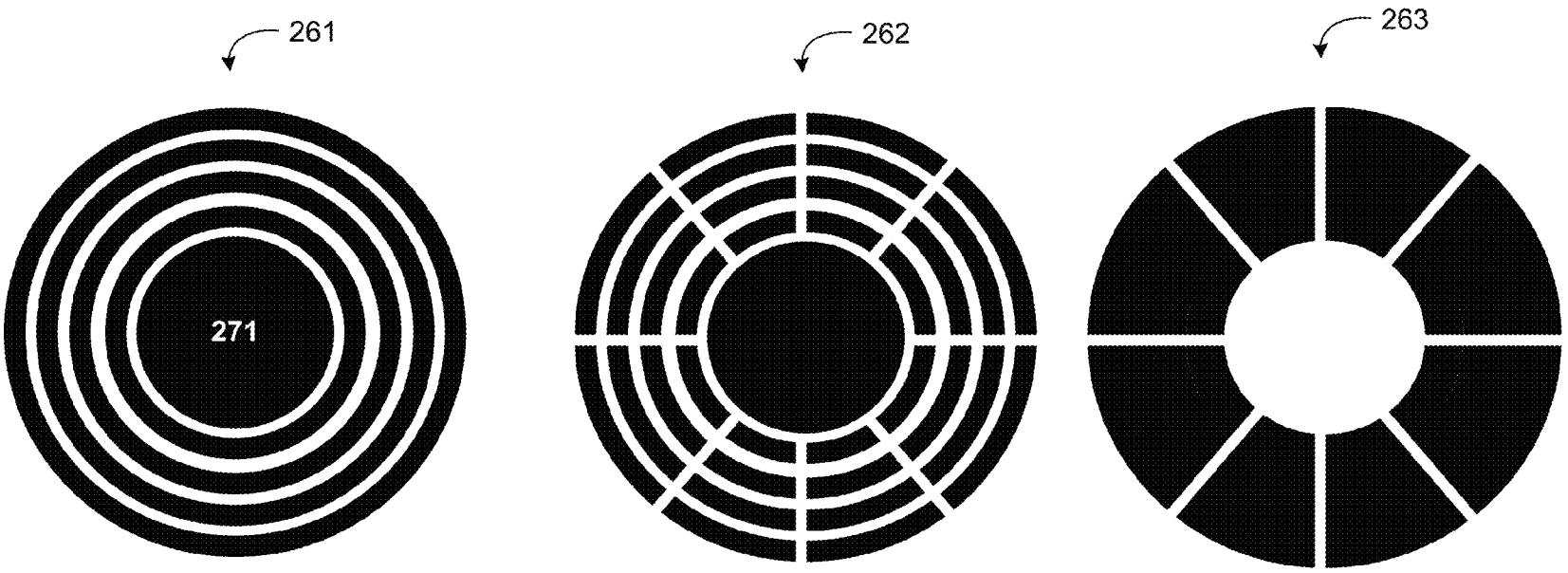
FIG. 5 is a diagram illustrating additional examples of a segmented emitter in accordance with embodiments of the technology described herein.

In yet another embodiment, by way of further example, the emitter segments can be arranged in a circular fashion to provide 2- or 3-dimensional control over the beamforming. FIG. 5 is a diagram illustrating additional examples of a segmented emitter in accordance with embodiments of the technology described herein. Emitter 261 shows an emitter configuration with a series of annular rings about a central emitter portion 271. Emitter 262 shows a plurality of segmented annular rings, and example 263 shows a series of emitter segments arranged in a circular fashion. As these examples serve to illustrate, these and any of a number of alternative emitter segment patterns can be implemented to provide an emitter capable of being steering any desired direction or configuration. Also, the number of emitter segments can vary from the examples shown in FIG. 5.

In operation the audio receiver/processor 220 may receive one or more audio signals from the audio source 210. An audio signal ("x") may, for example, be expressed as a sum of sinusoidal waves (tones):

$$x=\Sigma_i(X_i \sin(\omega_i t_0))$$

where $X_i$ corresponds to an amplitude of the tone represented by a sinusoidal wave $\sin(\omega_i t)$, where $\omega_i$ corresponds to a respective angular frequency ($2\pi f$) of the $X_i$ sinusoidal wave. For purposes of illustration, the present disclosure may refer to the one or more audio signals as an audio signal or the audio signal.

The audio signal may be processed by the processing module 221. For example, the audio signal may be equalized, filtered, etc., and modulated onto an ultrasonic carrier of a desired frequency.

For example, the audio signal (e.g., x) modulated onto an ultrasonic frequency carrier, with the ultrasonic angular frequency $\omega_c$ may be expressed as:

$$x'=\Sigma_i(X_i \sin(\omega_i t_0+\omega_c t_0))+X_c \sin(\omega_c t_0)$$

where $X_c$ corresponds to an amplitude of the ultrasonic frequency carrier signal and $\omega_c$ corresponds to an ultrasonic angular frequency of the sinusoidal wave of the carrier signal.

For clarity of description, the present disclosure describes an example processing of only one ultrasonic frequency modulated signal "x'". It is to be understood that one or more ultrasonic frequency modulated signals (e.g., $x_1'$, $x_2'$, $x_3'$ and $x_i'$) may be processed in the same or similar fashion. While multiple signals can be processed simultaneously, preferably only one signal set (e.g., a signal representing a given source and its respective delayed counterparts) is played through the emitter at a given time. In various embodiments as discussed herein, the system can be configured to switch between the various signal sets in a time-division multiplexed fashion to direct the audio content from the multiple sources to the intended listeners.

The time delay module 224 may delay in time one or more of the one or more ultrasonic frequency modulated signals, resulting in a relative time delay among the signals. In an example embodiment, the time delay module 224 may receive an ultrasonic frequency modulated signal x' and generate one or more time delayed ultrasonic signals by, for example introducing a time delay for each generated signal. The relative time delay may be accomplished through one or more delay lines, switches, phase shifters, etc. For example, time delay module 224 may generate a time delayed signal for each emitter section (e.g., emitter section 231, 232, 233, 234) of the directionally controllable emitter 230, or a time delayed signal for all but one of the emitter sections of the emitter 230. The example time delayed signals may be expressed as, for example:

$$a=\Sigma_i(X_i \sin(\omega_i t_a+\omega_c t_a))+X_c \sin(\omega_c t_a)$$

$$b=\Sigma_i(X_i \sin(\omega_i t_b+\omega_c t_b))+X_c \sin(\omega_c t_b)$$

$$c=\Sigma_i(X_i \sin(\omega_i t_c+\omega_c t_c))+X_c \sin(\omega_c t_c)$$

$$d=\Sigma_i(X_i \sin(\omega_i t_d+\omega_c t_d))+X_c \sin(\omega_c t_d)$$

where a, b, c and d represent example time delayed signals generated for emitter sections 231, 232, 233 and 234, respectively, and where $t_a$, $t_b$, $t_c$, and $t_d$ represent time delays of the a, b, c, and d signals respectively. The time delays $t_a$, $t_b$, $t_c$, and $t_d$ may be represented as a relative time delay with respect to the initial time delay (e.g., $t_0$) of the ultrasonic frequency modulated signal (e.g., x'). For example, the time delays $t_a$, $t_b$, $t_c$, and $t_d$ may be represented as:

$$t_a=t_0+\Delta a$$

$$t_b=t_0+\Delta b$$

$$t_c=t_0+\Delta c$$

$$t_d=t_0+\Delta d$$

where Δa, Δb, Δc and Δd represent example time delays, introduced by the time delay module 224*a*, with respect to the initial time (e.g., $t_0$) of the ultrasonic frequency modulated signal (e.g., x'). In practice, the initial time delay (e.g., $t_0$) can be with zero added delay. That is one of the signals is not delayed by the time delay module, other than normal propagation delays. In other words, consider an example in which $t_a$ is the signal to be delayed by $t_0$, in this case the system can be implemented such that Δa is a predetermined delay, which can include Δa=0.

The time delay module 224 and/or the audio receiver/processor 220 may send the $t_a$ time delayed signal to the emitter section 231, the $t_b$ time delayed signal to the emitter section 232, the $t_c$ time delayed signal to the emitter section 233, and the $t_d$ time delayed signal to the emitter section 234.

In embodiments where modulation is performed after the time delay, the time delay module 224 may generate one or more time delayed audio signals by, for example introducing a relative time delay for each generated signal. For example, the time delayed module 224 may generate one time delayed audio signal for each emitter section (e.g., emitter section 231, 232, 233, 234) of the directionally controllable emitter 230. The example time delayed signals may be expressed as, for example:

$$a'=\Sigma_i(X_i \sin(\omega_i t_a))$$

$$b'=\Sigma_i(X_i \sin(\omega_i t_b))$$

$$c'=\Sigma_i(X_i \sin(\omega_i t_c))$$

$$d'=\Sigma_i(X_i \sin(\omega_i t_d))$$

where a', b', c' and d' represent example time delayed audio signals generated for emitter sections 231, 232, 233 and 234, respectively, and where $t_a$, $t_b$, $t_c$, and $t_d$ represent time delays of the a', b', c', and d' signals respectively. The time delays $t_a$, $t_b$, $t_c$, and $t_d$ may be represented as a relative time delay with respect to the initial time delay (e.g., $t_0$) of the audio signal (e.g., x). For example, the time delays $t_a$, $t_b$, $t_c$, and $t_d$ may be represented as:

$$t_a=t_0+\Delta a$$

$$t_b=t_0+\Delta b$$

$$t_c=t_0+\Delta c$$

$$t_d=t_0+\Delta d$$

where Δa, Δb, Δc and Δd represent example time delays, introduced by the time delay module 224*b*, with respect to the initial time delay (e.g., $t_0$) of the audio signal (e.g., x). And, as noted above, one segment, can be configured with the added time delay set at zero (i.e., no added delay).

The modulator may modulate the time delayed audio signals (e.g., a', b', c', d') onto correspondingly delayed ultrasonic carrier signals of the desired parameters. For example, the time delayed audio signals (e.g., a', b', c', d') may be modulated onto an ultrasonic frequency carrier, with the ultrasonic angular frequency ω may be expressed as:

$$a=\Sigma_i(X_i \sin(\omega_i t_a+\omega_c t_a))+X_c \sin(\omega_c t_a)$$

$$b=\Sigma_1(X_1 \sin(\omega_i t_b+\omega_c t_b))+X_c \sin(\omega_c t_b)$$

$$c=\Sigma_i(X_1 \sin(\omega_i t_c+\omega_c t_c))+X_c \sin(\omega_c t_c)$$

$$d=\Sigma_i(X_i \sin(\omega_i t_d+\omega_c t_d))+X_c \sin(\omega_c t_d)$$

where $X_c$ corresponds to an amplitude of the ultrasonic frequency carrier signal and $\omega_c$ corresponds to an ultrasonic angular frequency of the sinusoidal wave of the carrier signal.

The audio receiver/processor 220 may send one or more ultrasonic frequency modulated signals to the directionally controllable ultrasonic emitter 230. For example, the modulator 223 (and/or the audio receiver/processor 220) may send the $t_a$ time delayed signal to the emitter section 231, the $t_b$ time delayed signal to the emitter section 232, the $t_c$ time delayed signal to the emitter section 233, and the $t_d$ time delayed signal to the emitter section 234.

In an example embodiment, time delay values of the respective time delayed signals (e.g., as determined by audio receiver/processor 220) may all be the same (e.g., $t_a=t_b=t_c=t_d$; the delays are all equal, or substantially equal, and they may all be zero) for each of the emitter sections (e.g., 231, 232, 233, 234) of the directionally controllable emitter 230 (i.e., no relative time shift among the emitter sections). When the values of the time delays of the respective time delayed signals are all equal (i.e., there is no relative time delay), the power of the signal outputted from the directionally controllable emitter 230 will typically be stronger than the case in which the segments of the directionally controllable emitter are driven by signals delayed relative to one another. The amount of increase in signal power may depend on the number of emitter sections (e.g., 231, 232, 233, 234). As a result, the ultrasonic beam generated by the directionally controllable ultrasonic emitter 230 may be an ultrasonic directional beam aimed at a default direction.

With reference again to FIG. 3, listener 240B is located directly in front of the emitter. In this example, with equal delays (which can include no added delays as noted above), the beam is directed in a direction normal to the emitter face and users 240A, 240C are outside of the beam of emitter 230. In another embodiment, the time delays used to shift the signal sent to the various emitter sections can be adjusted to steer the beam in another direction. For example, the beam can be steered toward listener 240A or listener 240C without the need to physically reorient or reposition emitter 230. Because ultrasonic emitters are generally highly directional, it may be desirable in some embodiments to steer the audio-modulated carrier signal in a particular predetermined direction.

Figure 6A:
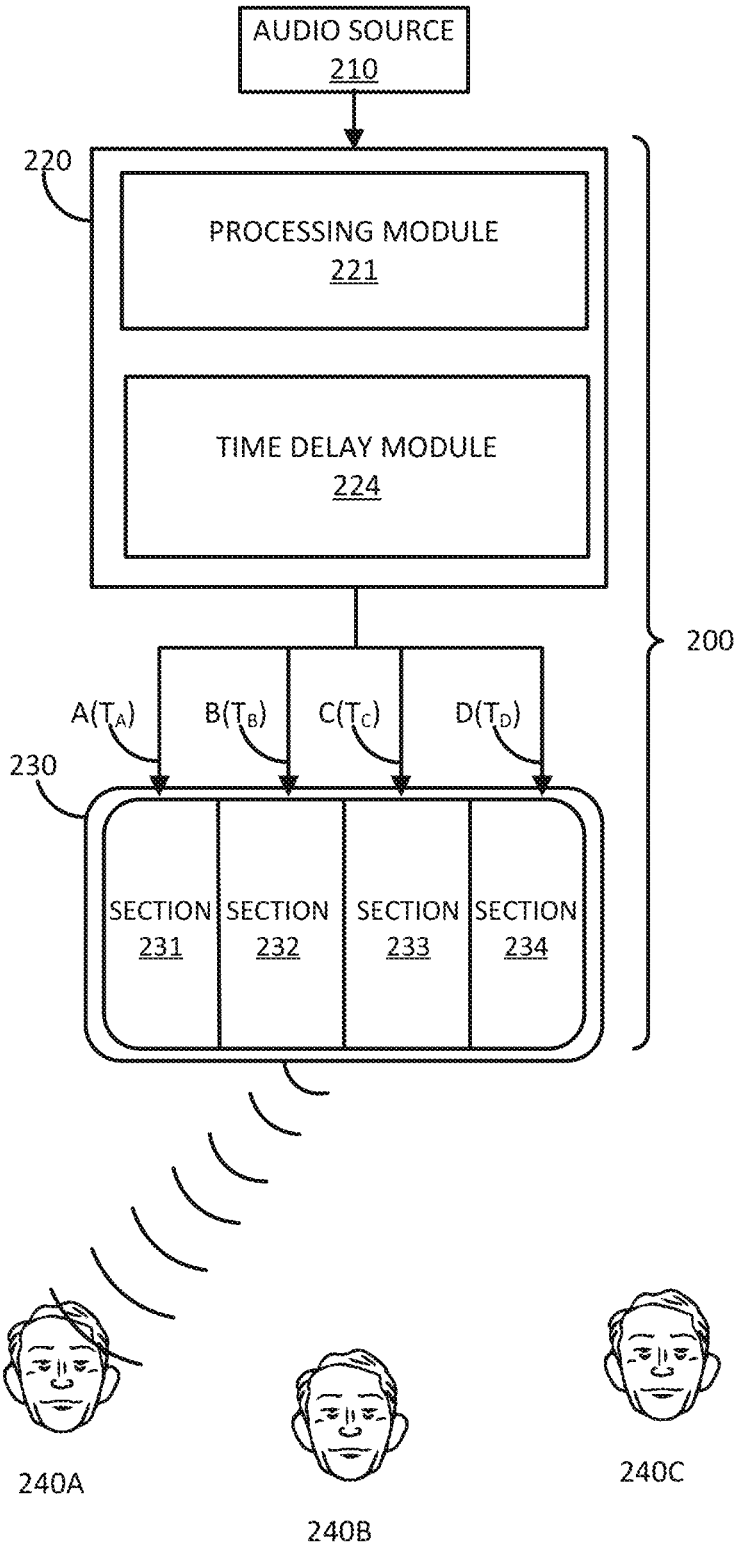
FIGS. 6A and 6B, is a diagram illustrating an example of results that may be obtained by varying the respective time delay of signals.
Figure 6B:
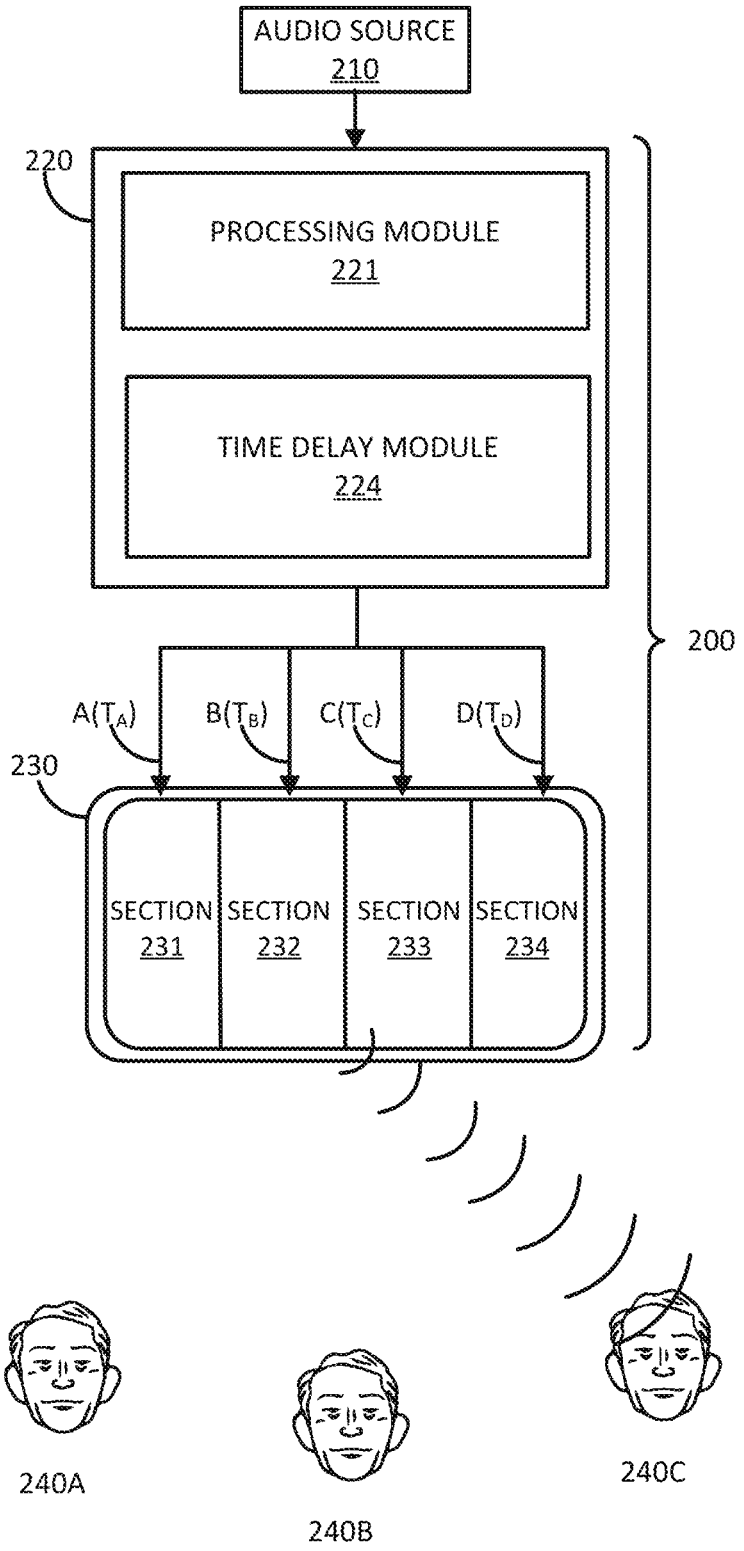

FIG. 6, which comprises FIGS. 6A and 6B, is a diagram illustrating an example of results that may be obtained by varying the respective time delay of signals generated by the audio receiver/processor 220 and sent to respective sections of a directionally controllable ultrasonic emitter 230. Referring to FIG. 6A, in this example, the audio receiver/processor 220 is configured to delay the signals to the emitter sections, where the time delays have been chosen to steer the entire signal to the right (from the perspective of the directionally controllable ultrasonic emitter) toward listener 240A. Such an effect may be achieved by introducing an increasing amount of delay in the audio signal going from right to left (in the FIG.).

For example, $t_d$ may be selected to be equal to $t_0$ (no added time delay, or some determined amount of time delay) and $t_a$, $t_b$, and $t_c$, may be selected such that $t_d<t_c<t_b<t_a$, such that signals a, b, c and d are time delayed with respect to each other.

In this example, user 240A is located in the path of the steered beam from the emitter 230, and users 240 B and 240 C are outside of the beam of the directionally controllable ultrasonic emitter.

The example shown in FIG. 6B, is similar to that of FIG. 6A, except that the beam is steered toward a listener 240C instead of listener 240A. In this example, the time delays are chosen to steer the signal to the right from the perspective of the directionally controllable ultrasonic emitter toward listener 240*c*. This can be accomplished, for example, by introducing an increasing time delay in signals sent to the emitter segments going from left to right (in the FIG.).

For example, $t_a$ may be selected to be equal to $t_0$ (no time delay) and $t_b$, $t_c$, and $t_d$, may be selected such that $t_a<t_b<t_c<t_d$, such that signals a, b, c and d are time delayed with respect to each other.

The amount of beam steering is affected by the amount of time delay introduced into the signal sent to the emitter segments. Increasing the delay, increases the angle at which the audio-modulated ultrasonic signal is launched from the emitter.

In addition to steering the beam to the left or the right as described above, the delays can be configured to focus the beam toward the center or to spread the beam (cause it to diverge) as it travels away from the emitter. For example, increasing delays from the center segment(s) toward the outer segments will cause the beam to diverge, while increasing delay from the outer segments toward the inner segments can focus the beam. In some embodiments, the beam can be focused to a point (i.e., to a relatively small depth) such that it can be directed toward a specific listening area defined not only in the left/right or up/down dimension, but also in depth. This can be used to control the distance at which the sound is produced and help avoid having the sound emitted from the segmented emitter from traveling farther than desired, which may be desirable for certain applications or environments. Consider, for example, and in-home environment for watching television. The emitter can be configured to focus the sound to the distance at which the listener is located (e.g., distance from the television/emitters to the sofa). With a sufficiently tight depth of focus, the listener can enjoy the sound from the television without disrupting others who may be in front of or behind the listener. As another example, consider an environment in which the segmented emitter is used for a kiosk in a public location. The emitter can be configured to focus the sound to a distance at which the listener is anticipated to be positioned while accessing the kiosk. With a sufficiently tight depth of focus, the sound from the emitter will reach the listener, and will be sufficiently diminished beyond the listener such that others in the public location cannot effectively hear the content that is being provided by the kiosk to the listener.

Consider another example of a theater or auditorium in which content is being delivered to a plurality of listeners in multiple languages. Sections of the theater or auditorium defined as being designated for each language in which the audio content is to be delivered. The emitter or emitters can be configured to direct the content in each given language to its respective corresponding section. This can be done by directional control (e.g., left/right), or by depth control (e.g. focusing the emitter), or a combination of both. As noted above, the different audio content (i.e. the different languages) can be multiplexed through a single emitter and the directionality of the emitter changed to handle each corresponding input. That is, for example, the audio content for each language can be multiplexed in time and the amounts of delay switched in sync with the multiplexing to direct each language portion of the multiplexed signal to its intended location.

As this example illustrates, time division multiplexing can be used to direct different audio content (using different signal sets) to different listeners by multiplexing the signal sets in time and playing them through the emitter in a multiplexed stream. Because the human ear is unable to perceive short gaps in content, this multiplexing mechanism can provide different targeted listeners with their own respective content, effectively providing multiple sound systems using a single segmented emitter. Likewise, the system can take advantage of natural breaks in content (pauses, etc) to multiplex other content for other listeners into the dead space provided by such breaks or pauses.

Although the exemplary ultrasonic emitter system utilizing a directionally controllable ultrasonic emitter is illustrated as comprising a single audio receiver/processor (e.g., the audio receiver/processor 620), the present disclosure is not limited in this way. For example, each section of a directionally controllable emitter may comprise a dedicated audio receiver/processor that may or may not be physically integrated with the respective emitter section(s). In another example, one or more of the emitter sections may share one or more audio receivers/processors that may or may not be physically integrated with any of the emitter section(s). It is to be understood that the present disclosure is not limited to any particular implementation of an ultrasonic emitter system that utilizes a directionally controllable ultrasonic emitter and that the technology may comprise various embodiments, that may or may not be described herein, that are not inconsistent with the present disclosure.

In various embodiments, this beam steering can be implemented to target a particular listening area or a particular listener (e.g., an individual listener or a listener group). For example, in some environments, sensors can be used to determine whether or not a listener is in a particular listening area. Those sensors can be configured to feed information to the ultrasonic emitter system indicating which of the plurality of listening areas is populated. Any of a number of sensors can be used to detect the presence of listeners in the listening area including, for example, ultrasonic sensors, infrared sensors, optical or infrared beams, pressure sensors, near-field or RFID sensors, and so on.

Such listening areas can be predetermined and their locations predefined in the system. Accordingly, the audio receiver/processor 220 can determine the correct amount of time delay to introduce into the signal sent to the emitter segments to steer the beam toward an identified populated area. Lookup tables or other like techniques can be used to store information regarding designated areas and their coordinates or location relative to the emitter. Feedback devices can be included and installed in the listening areas. These devices can be used to verify that the audio-modulated ultrasonic signals are in fact redirected toward a particular listening area. Simple audio microphones can be used to detect the presence of an ultrasonic signal to confirm that the beam is properly steered. The microphone can be connected to, for example, a low pass filter to filter out background noise so that it can detect the presence of a higher frequency ultrasonic signal.

This can be useful in a number of applications including, for example, where there are a number of different listening areas or "stations" in an area that can be serviced by a single directionally controllable emitter. As a listener (or group of listeners) moves from area to area, the system can be configured to detect their presence in a given area, and deliver that particular audio content to that area using beam steering. Accordingly, area-specific content can be targeted to and delivered to its corresponding listening area. As a further example, this can be useful in a museum that has a number of different exhibits each in its own area. Audio content specifically suited for each exhibit can be stored in the system and retrieved when the sensors detect that a patron is at an exhibit. When the sensors detect the presence of a patron at an exhibit, the system can be configured to retrieve the audio content for that exhibit, modulate it onto an ultrasonic carrier, and deliver it to that particular area (and no other areas) using the beam steering techniques such as those described above. Likewise, for a listener in another area of another exhibit, the system can retrieve the content for that exhibit and deliver that content using beam steering to that patron.

Thus, as this example serves to illustrate, the system can be configured to provide content (area-specific or otherwise) to a particular listening area or to a user. After reading this description, one of ordinary skill in the art will recognize a number of other applications in which such a system can be implemented. For example, airports, train stations, customs bureaus and the like can use a system such as this to provide specific directions or instructions to patrons as they move from one area to another in the system. As another example, in a retail environment, as patrons move from one product display to the next, such a system can be used to target information to the patrons about the product they are currently viewing. This can include product information, sale information, or other information that might be material to the patron as he or she browses the merchandise.

The examples described above reference the use of sensors in the environment to detect the presence of a listener in a particular area. In other embodiments, the system can be configured to track the movement of the user through a listening environment continuously, substantially continuously, or intermittently, and steer the beam toward the listener as he or she moves about through a listening environment. Thus, a dynamic system can be created in which a beam can be configured to follow a user, for example in real-time or near-real-time. Intermittent steering may be useful, for example, where the content is delivered intermittently, and the steering can be temporally coordinated to correspond to the timing of the content delivery.

Figure 7:
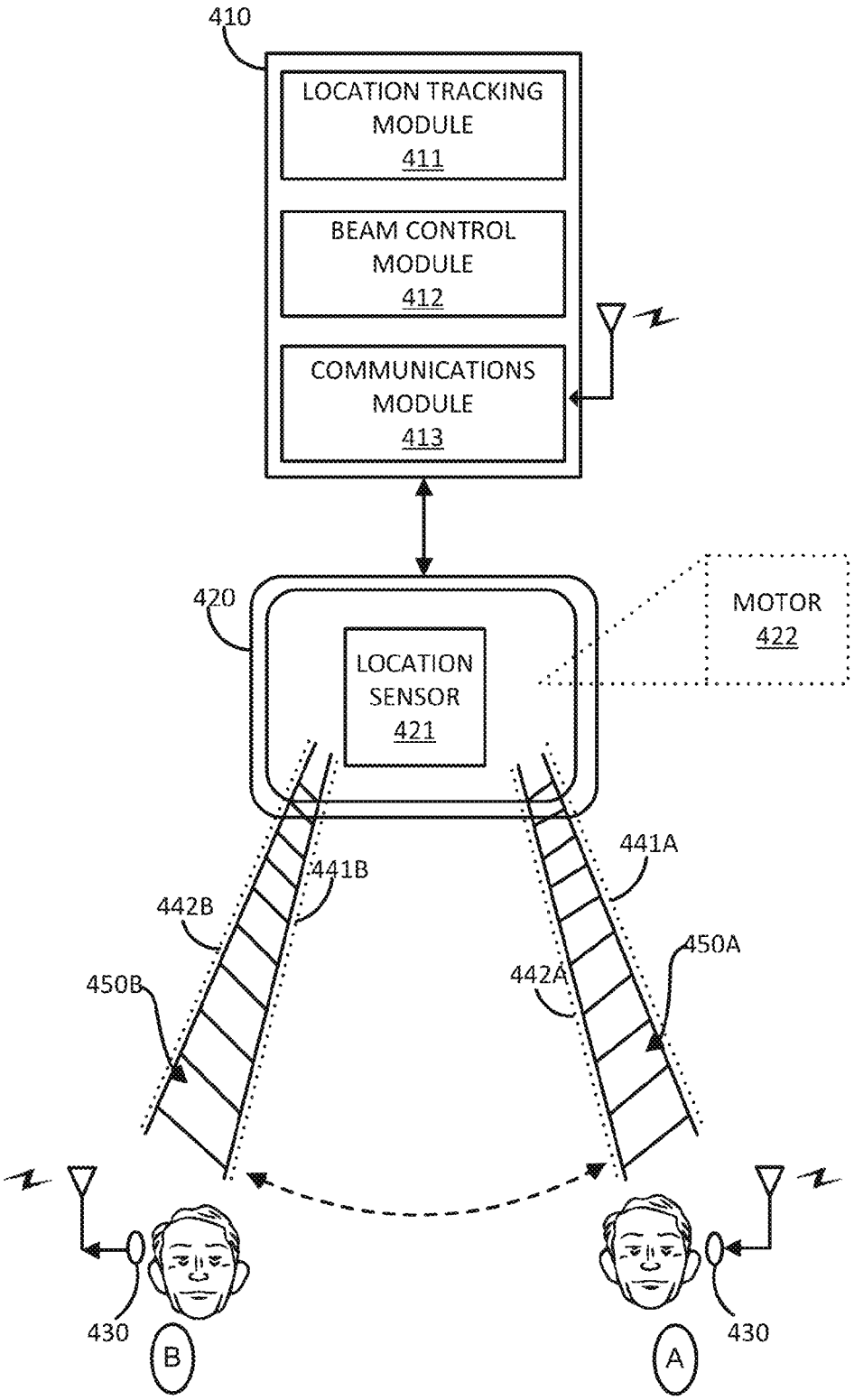
FIG. 7 is a block diagram illustrating an example ultrasonic emitter system that utilizes an ultrasonic emitter with adaptive user location, in accordance with one embodiment of the technology described herein.

FIG. 7 is a block diagram illustrating an example ultrasonic emitter system that utilizes an ultrasonic emitter with adaptive user location, in accordance with one embodiment of the technology described herein. As noted above, due to the highly directional nature of ultrasonic emitter systems, it may be desirable to dynamically adjust the directionality of the ultrasonic signals in response to a movement or change in location of one or more users of the system. For example, it may be desirable to direct the ultrasonic signals generated by the ultrasonic emitter system toward the head (or heads) of one or more listeners. When the listener is within the path of the emitted ultrasonic signal, the listener is able to hear the audio content as it is demodulated in a medium (e.g. air) between the emitter and the listener. When the listener moves out of the path of the signal, he or she may not be able to experience the full effect of or may not hear at all the corresponding audio signals carried by ultrasonic signal.

The ultrasonic audio system in this example includes an audio processor module 410 and an emitter 420. Audio processor module 410 in this example includes a location-tracking module 411, a beam-control module 412 and a communications module 413. Also illustrated is a location sensor 421 and a motor 422 or other position adjustment module. Although location sensor 421 is shown as collocated with emitter 420, location sensor 421 can be located elsewhere in the system or in the listening environment. Audio processor module 410 may include components used to process the audio content and modulate the content onto an ultrasonic carrier such as, for example, processing modules described above with reference to FIGS. 1 and 2. Audio processor module 410 may also include a time delay module such as that shown above with reference to FIG. 3 to provide beam steering of the segmented emitter. This time delay module can be included, for example, in beam control module 412.

The location-tracking module 411 may comprise suitable circuitry, interfaces, logic, and/or code (e.g., computer program code stored in a non-transitory storage medium and operating on one or more processors) that may be operable to track the location of one or more listeners in the listening environment. The location-tracking module 411 can be used by the system to determine the location of a listener such as, for example, by employing one or more location sensors 421 that sense the location of the listener. Multiple location sensors 421 can be included with the system and mounted at different locations in the listening environment such that a listener's position can be determined in two or three dimensions. For example, location sensors can be wall mounted, ceiling mounted, mounted on stands, mounted on or as part of the emitter, be integrated as a part of the audio equipment (e.g., sources 2 of FIG. 1) or the emitter system, and so on.

Location tracking module 411 can include a processing module configured to triangulate position information received from multiple location sensors 421. Likewise, 2D or 3D image sensors such as, for example, optical or infrared image sensors, can be employed to provide more granular position information without the need for location tracking module 411 to perform triangulation. Location sensors can include, for example, infrared sensors, optical sensors, sonic, ultrasonic, RF, RFID and near-field sensors; radar sensors and so on.

The location-tracking module 411 may be configured to communicate with one or more location sensors 421 to receive location information about one or more listeners in the listener environment. In some embodiments, one or more sensors can be used to track multiple listeners. For example, facial recognition or other individual recognition techniques can be used to allow the sensor and tracking module to track the location of multiple particular individuals in the listening environment. This can be done, for example, to allow emitters to direct audio content at one or more particular users. For example, in some embodiments, it may be desirable to provide different or unique audio content to different users. Accordingly, the system can be configured to identify particular listeners in the listening environment and to direct listener-specific content to each listener as appropriate by the system or application. Additionally, facial recognition can be used to trigger the system such that it operates only upon the detection of an identified particular listener. In such embodiments, while the system may detect a plurality of people in the listening environment, the system can be configured to perform facial recognition and to only emit audio content upon the recognition of a particular specified individual.

Embodiments can therefore be implemented in which users can subscribe to audio content and the audio content delivered only to subscribing users. As a further example, consider an application of the system in the environment of a museum or other like venue. People visiting the museum can opt to subscribe to an audio tour to allow them to hear information about exhibits as they move from one exhibit to the next. Additionally, people can choose to subscribe to content in a particular language or at a particular age-appropriate level such that content can be targeted to individual listeners. By using facial recognition (e.g., an optical or other like sensor with associated facial recognition software), RFID tags, barcodes or other like optical identifiers (for example, one a badge worn by the tour goer) or other identification-specific sensors to uniquely identify individuals, the system can be configured to deliver targeted content to particular listeners, and only to those particular listeners. Accordingly, subscriptions can be controlled and information can be tailored to suit the particular listeners to enhance their experience.

Facial recognition can also be considered in terms of an example application of a video game environment in which multiple players are engaged in gameplay in the same listening environment. The tracking and sensor modules can be configured to track the individual gamers as they move about the listening environment. As they are engaged in gameplay and potentially moving about the listening environment, the system can be configured to provide common audio content to all the listeners, as well as individual, unique content to each individual listener. For example, the system can identify a particular listener among a group of listeners, identify corresponding audio content that is uniquely intended for that listener, determine that listener's location in the listening environment, and direct the listener-specific audio content to that listener. The same or similar operations can be done for other listeners in the environment simultaneously or on a one-at-a-time fashion. Multiple emitters can be used so that each emitter can emit ultrasonic signals bearing a unique audio content to its corresponding listener. A single emitter (or fewer emitters than the number of listeners) can also be used and audio content directed at individual listeners in a shared (e.g., time interleaved or multiplexed) fashion.

In the video game environment, dedicated sensors can be provided for the emitter system to track the movement of the gamers in the environment. Alternatively, in other embodiments, the system can be integrated with the gaming system and make use of position and movement sensors used for gameplay. For example, conventional videogame devices such as the Xbox360® include a sensor system to detect the location and movement of players in the environment. The emitter system can be integrated with or otherwise communicatively coupled to the gaming environment such that information from the gaming sensor can be fed to the emitter system to direct the sound to the detected gamers.

In addition to facial recognition, other identification techniques can be used to identify particular listeners among multiple listeners in the listening environment. For example, RFID tags or other location tags can be used. Likewise, users can be given a badge, a sticker, or a particular item or article of clothing to wear to facilitate tracking of individual listeners among multiple listeners in the listening environment. In a larger environment, GPS, cellular, or other like technologies can be used to track listeners and that information fed to the emitter system such as, for example, via communications module 413. As these examples serve to illustrate, there are a number of techniques that can be used to identify and track individual participants or listeners in the listening environment. As these examples also serve to illustrate, there may be a number of different applications in which a system that is able to track one or more listeners can be implemented.

As another example, consider a situation such as where multiple different individuals are in an environment to enjoy entertainment content such as, for example, a movie. Because movies can have different ratings (e.g., G, PG, R, and so on) and because oftentimes people may wish to enjoy such content with their families, it may be desirable to provide audio content of different ratings to different listeners present within the listening environment. For example, a G rated soundtrack with expletives deleted can be provided for younger viewers, while a more mature soundtrack without the expletives deleted can be provided to the more mature viewers in the audience. In such an environment, facial recognition or other identification information can be used to identify and determine the position of particular users in the listening environment. The system can be configured to use this information to direct the appropriate audio stream (e.g., content with the appropriate rating) to the corresponding identified listeners. Accordingly, the family can watch a movie with different soundtracks being provided to each of the individual listeners (or groups of the listeners).

As another example, content can be provided in multiple different languages to a plurality of listeners in the listening environment. The system can likewise be configured to identify and track particular listeners and deliver the appropriate content in the appropriate language to the identified listeners.

In environments where a listener may move about the listening area, the system can be configured to follow the listener so that the audio content in the appropriate language is directed to the appropriate listener as he or she moves about the listening area. As noted above, this can be done in a time-interleaved fashion, directing audio content to listeners in different languages in interleaved fashion. Alternatively, multiple emitters can be provided to direct content to the individual listeners and each emitter can be configured to track the location of the listeners as they move about the environment.

Such systems can be suitable for a number of different environments including, for example, schools, museums, airports, train stations and other transportation locations, sporting and concert venues, public and private gathering places, churches, retail environments, and so on.

In some embodiments, the system can be configured to allow a user to register with the system and identify his or her preferences for language, content, content rating (G, PG, R, etc.), volume levels, or other parameters that may be identified or used to identify or tailor particular audio content for that particular user. The user can also register his or her form of identification with the system such as, for example, by registering his or her face with the system, a particular RFID tag, or other identification means. Registration information and user preferences can be stored in a database, memory or other storage means for use by the system in operation.

As another example, position information can be tied to videogame controllers in a gaming environment. Information from the controllers such as, for example, information sent by a signal emitted from the controllers, can be used to identify the controllers and, accordingly, gamer-specific audio content can be delivered to the gamer associated with the controller by directing the modulated ultrasonic signal toward the tracked controller.

As noted above, in some applications it may be desirable to alter the content on a listener-by-listener basis. In other embodiments, it may be desirable to alter the content delivered to the listener relative to that listener's position in the environment. For example, in a museum or other display environment as a listener moves from one display to another, the system can be configured to determine the appropriate content to deliver to the listener based on his or her location. This can be combined with listener-by-listener content delivery as well.

As illustrated in the example of FIG. 7, a location sensor 421 can be co-located with the emitter to provide position information relative to the emitter positioned. In other embodiments, location sensors can be implemented in other places in the listening environment to identify the position of the listener. In some embodiments, the position of the listener can be identified in terms of a direction and distance from the emitter itself. In other embodiments, the position of the listener can be identified based on a position of the listener in a coordinate system relative to the listening area. In the latter case, processing module 410 can be configured to steer the beam or otherwise position the emitter such that the ultrasonic signals are emitted to reach that identified location in the listening area.

In further embodiments, the system can be configured not only to identify the position of the listener, but to further identify the location of the listener's head in particular. In this manner, the ultrasonic beam can be more precisely targeted to the listener's head as opposed to targeted toward the listener in general. Head detection may be accomplished by a number of techniques including, for example, visual detection and identification of the head based on its shape or size, or based on markers that the user wears on his or her head, face, or other location proximal the head or ears.

Upon receiving information from the sensors, location-tracking module 411 provides information to the beam-control module 412 to adjust the direction of the beam emitted from the emitters accordingly. In other words, in an embodiment where a directionally controllable emitter system is used, processing module 410 (whether location tracking module 411 or beam control module 412) computes the time delay for the segments of the emitter 420 that would be appropriate to direct the beam to the user's tracked location. This can be done on a periodic basis or on a continuous basis as the user moves from place to place.

In yet other embodiments, mechanical emitter steering can be used to direct the ultrasonic signals to the listener. For example, one or more motors 422 can be used to adjust a mount of the emitter to physically orient the emitter in the direction of the listener. A gimbal, azimuth-elevation, XY or other like mount can be used to provide movement or orientation of the emitter in multiple directions (e.g., in azimuth and elevation) to "aim" the emitter at the listener in the detected position. Other control mechanisms in addition to motors can be used to physically adjust the orientation of the emitter. These can include, for example, magnetic positioning systems, hydraulic systems, and so on.

As noted above, a communications module 413 can be provided to enable communications with other devices and with a remote control (discussed below). As yet another example, communications module 413 can be used to communicate with modules 430 associated with the listeners. These modules 430 can include, for example, position determination modules to enable identification of the listeners positions, and communication of that position to the system via communication module 413. The communication module 813 may be configured to support one or more wired and/or wireless protocols, standards and/or interfaces (e.g., Ethernet, Bluetooth, WiFi, satellite and/or cellular network, WiMAX, WLAN, NFC, etc.) or proprietary protocols can be used. Communications module 413 can also be used, for example, to communicate with a system with which the emitter system is integrated. For example, in communications module 413 may be used to communicate with the gaming system such that content information or content specific information can be provided to the emitter system from the gaming system for use in providing content to a particular listener such as, for example, listener-dependent information or position-dependent information.

In some embodiments, the emitter can be configured to also emit a visible light in a directional nature such that the light is emitted in the same, substantially the same, or roughly the same direction as the emitted ultrasonic beam. For example, a low-power laser, focused light (e.g., using a lens or optical beam steering system), or other light source can be colocated with the emitter and directed such that the listener can determine whether he or she is in the path of the ultrasonic signals based on whether or not he or she can see the emitted light.

In an example embodiment, the one or more visible beams may be utilized to indicate to the listener whether or not he or she is in the path of the ultrasonic beam, or to inform the listener of an acceptable movement area within which he or she should remain in order to hear audio content from the ultrasonic emitter. In another example, the listener can be given the ability to control the direction of the light emitted from the light source such that this light is aimed in the direction of the listener. The processing system can be configured to adjust the time delay of the directionally controllable emitter to direct the ultrasonic beam in the same direction as the light. In this manner, the listener can, in effect, indicate to the system where he or she is positioned and the system can redirect the ultrasonic signal accordingly.

In non-directionally controllable configurations, the system can be configured to determine offset angles between the emitter and the light source such that when the listener adjusts the direction of the light source the system can redirect the ultrasonic emitter so that it is oriented in the direction of the adjusted light source.

In another example embodiment, the listener may adjust the location and spread of the light emitted from the light source to define an area within which the listener wants to be identified or tracked. For example, a remote control device can be used to adjust the orientation and spread of the light beam to define an area within which the user would like to be tracked and identified. The remote control device can include a d-pad, joystick, or other controller mechanisms to allow the user to control the light source or to control the orientation of the ultrasonic emitter itself. In addition to or in place of a mechanical interface, a graphical user interface can be provided, which can include a touchscreen display for example, to operate the remote control. The remote control can be used, for example, for initial setup of the system or during use to allow the listener to define a listening area or to orient the emitter mechanically. In further embodiments where the emitter is a directionally controllable emitter, the remote control can be used to steer the beam electronically.

The remote control device may include input-output module to enable the user to interact with the ultrasonic emitter system using the remote control. The input-output subsystem may support various types of inputs and outputs, including, for example, mechanical, video, audio, and textual. Example (external or integrated) input-output devices may include, for example, displays, mice, keyboards, touchscreens, voice input interfaces, vibration mechanisms, still image and/or video capturing devices or other input-output interfaces or devices.

The adjustment of one or more ultrasonic beams in response to an adjustment of the one or more visible beams may be performed by any method consistent with the present disclosure. For example, the location tracking module 411 may analyze the information and/or data received from a location sensor 421, where the date is indicative of a change in location of the one or more visible beams. The location tracking module 411 may request from the beam control module 412 to adjust the directionality and dispersion of the one or more ultrasonic beams based on the information.

In yet another embodiment, a remote control can be configured to be uniquely associated with a particular listener of the system. Remote controls and individual listeners can be associated with particular emitters to allow one or more particular emitters to be dedicated to one or more identified listeners. Accordingly, the listener may be given the ability to adjust one or more emitters independently of another listener's adjustments to his or her corresponding emitters.

Although the location tracking module 411, the beam control module 412 and the communications module 413 are illustrated as part of the audio processor 410, one of ordinary skill in the art will understand that these modules can be configured and located differently from that shown in the example of FIG. 7. It is noted that these modules can, in some embodiments, be integrated with the audio processing system such as that shown, for example, in FIGS. 1 and 2.

Figure 8:
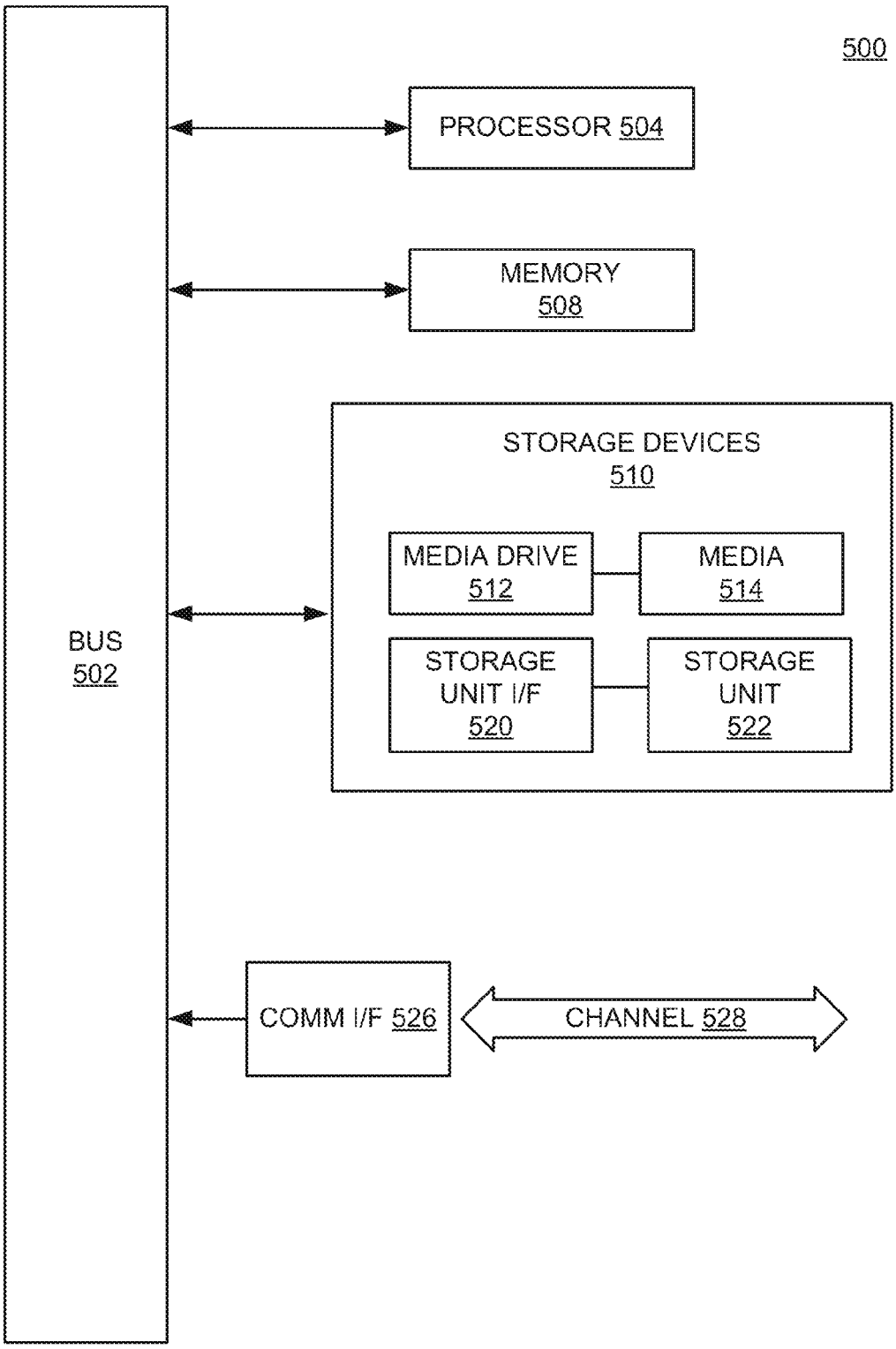
FIG. 8 illustrates an example computing module that may be used in implementing various features of embodiments of the disclosed technology.

As used herein, the term module might describe a given unit of functionality that can be performed in accordance with one or more embodiments of the technology disclosed herein. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the technology are implemented in whole or in part using software, in one embodiment, these software elements can be implemented to operate with a computing or processing module capable of carrying out the functionality described with respect thereto. One such example computing module is shown in FIG. 8. Various embodiments are described in terms of this example-computing module 500. After reading this description, it will become apparent to a person skilled in the relevant art how to implement the technology using other computing modules or architectures.

Referring now to FIG. 8, computing module 500 may represent, for example, computing or processing capabilities found within desktop, laptop and notebook computers; hand-held computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 500 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 500 might include, for example, one or more processors, controllers, control modules, or other processing devices, such as a processor 504. Processor 504 might be implemented using a general-purpose or special-purpose processing engine such as, for example, a microprocessor, controller, or other control logic. In the illustrated example, processor 504 is connected to a bus 502, although any communication medium can be used to facilitate interaction with other components of computing module 500 or to communicate externally.

Computing module 500 might also include one or more memory modules, simply referred to herein as main memory 508. For example, preferably random access memory (RAM) or other dynamic memory, might be used for storing information and instructions to be executed by processor 504. Main memory 508 might also be used for storing temporary variables or other intermediate information during execution of instructions to be executed by processor 504. Computing module 500 might likewise include a read only memory ("ROM") or other static storage device coupled to bus 502 for storing static information and instructions for processor 504.

The computing module 500 might also include one or more various forms of information storage mechanism 510, which might include, for example, a media drive 512 and a storage unit interface 520. The media drive 512 might include a drive or other mechanism to support fixed or removable storage media 514. For example, a hard disk drive, a floppy disk drive, a magnetic tape drive, an optical disk drive, a CD or DVD drive (R or RW), or other removable or fixed media drive might be provided. Accordingly, storage media 514 might include, for example, a hard disk, a floppy disk, magnetic tape, cartridge, optical disk, a CD or DVD, or other fixed or removable medium that is read by, written to or accessed by media drive 512. As these examples illustrate, the storage media 514 can include a computer usable storage medium having stored therein computer software or data.

In alternative embodiments, information storage mechanism 510 might include other similar instrumentalities for allowing computer programs or other instructions or data to be loaded into computing module 500. Such instrumentalities might include, for example, a fixed or removable storage unit 522 and an interface 520. Examples of such storage units 522 and interfaces 520 can include a program cartridge and cartridge interface, a removable memory (for example, a flash memory or other removable memory module) and memory slot, a PCMCIA slot and card, and other fixed or removable storage units 522 and interfaces 520 that allow software and data to be transferred from the storage unit 522 to computing module 500.

Computing module 500 might also include a communications interface 524. Communications interface 524 might be used to allow software and data to be transferred between computing module 500 and external devices. Examples of communications interface 524 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 524 might typically be carried on signals, which can be electronic, electromagnetic (which includes optical) or other signals capable of being exchanged by a given communications interface 524. These signals might be provided to communications interface 524 via a channel 528. This channel 528 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 508, storage unit 520, media 514, and channel 528. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 500 to perform features or functions of the disclosed technology as discussed herein.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An ultrasonic audio system, comprising:

a location sensor;

a location tracking module configured to receive information from the location sensor and to determine a location of a listener in a listening environment;

a time delay module configured to receive audio content and to generate a plurality of audio content signals, the generated audio content signals comprising a plurality of individual instances of the audio content signal each instance delayed in time relative to the other instances of the audio content signals;

an ultrasonic emitter comprising a plurality of electrically isolated sections, each section having an input electrically coupled to receive one of the individual instances of the audio content signal, and configured to emit an audio-modulated ultrasonic signal from each of the plurality of electrically isolated sections; and a plurality of selectable interconnects, selectively electrically connecting adjacent pairs of the electrically isolated sections, wherein an amount of delay inserted for each instance of the audio content is computed so that a composite audio-modulated ultrasonic signal emitted by the emitter is directed toward the determined location of the listener.

2. The ultrasonic audio system of claim 1, wherein the location tracking module is further configured to track the location of the listener as the listener moves about in the listening environment, and the time delay module is further configured to adjust the relative delays of the instances of the audio content signal so that the composite audio-modulated ultrasonic signal emitted by the emitter is directed toward the listener as the listener moves about the listening environment.

3. The ultrasonic audio system of claim 2, wherein the sensor comprises an identification-specific sensor and the location tracking module is configured to track the location of a specific identified listener such that the composite audio-modulated ultrasonic signal emitted by the emitter can be directed toward the identified listener as the specific identified listener as that specific identified listener moves about the listening environment.

4. The ultrasonic audio system of claim 3, wherein the identification-specific sensor comprises at least one of an RFID tag, a barcode, an optical identifier, and a facial recognition sensor.

5. The ultrasonic audio system of claim 1, wherein the sensor comprises an identification-specific sensor and the ultrasonic audio system is configured to emit an ultrasonic audio signal only upon the detection of the specified listener.

6. The ultrasonic audio system of claim 1, wherein the sensor comprises an identification-specific sensor and the location tracking module is configured to track the location of a plurality of identified listeners, and further wherein the ultrasonic audio system is configured to receive a plurality of different audio content streams and to interleave the plurality of different audio content streams into a multiplexed signal, and the time delay module is configured to generate individual instances of the audio content signal for each audio content stream, such that the audio content corresponding to each audio content stream can be delivered to its intended listener.

7. The ultrasonic audio system of claim 1, wherein the location sensor comprises a plurality of location sensors.

8. The ultrasonic audio system of claim 1, wherein the location sensor comprises at least one of an infrared sensor, optical sensor, sonic sensor, ultrasonic sensor, RF sensor, GPS location detector and pressure sensor.

9. The ultrasonic audio system of claim 1, further comprising an audio processing module configured to receive the audio content from an audio source and to process the audio content for delivery by way of an ultrasonic carrier.

10. The ultrasonic audio system of claim 1, further comprising a modulator configured to modulate the received audio content onto an ultrasonic carrier.

11. The ultrasonic audio system of claim 1, wherein the ultrasonic emitter comprises a conductive backplate, a conductive emitting surface, and an insulting layer disposed between the conductive backplate and the conductive emitting surface, and further wherein the conductive emitting surface comprises a plurality of conductive sections separated by insulating sections interposed between the conductive sections.

12. The ultrasonic audio system of claim 1, wherein the time delay differences between the plurality of individual instances of the audio content are chosen to steer the audio-modulated ultrasonic signal emitted by the emitter in a predetermined direction relative to a face of the emitter.

13. The ultrasonic audio system of claim 1, wherein the time delay differences between the plurality of individual instances of the audio content are chosen to focus the audio-modulated ultrasonic signal emitted by the emitter at a distance from a face of the emitter.

14. The ultrasonic audio system of claim 1, wherein the time delay differences between the plurality of individual instances of the audio content are chosen to control a distance from the emitter at which sound is produced by the audio-modulated ultrasonic signal.

15. The ultrasonic audio system of claim 1, wherein the plurality of electrically isolated sections are arranged horizontally across the emitter.

16. The ultrasonic audio system of claim 1, wherein the plurality of electrically isolated sections are arranged as a matrix on a face of the emitter.

17. The ultrasonic audio system of claim 16, further comprising a control module configured to control the selectable interconnects to selectively connect one or more adjacent pairs of the electrically isolated sections of the emitter.

18. The ultrasonic audio system of claim 16, further comprising a control module configured to control a direction in which an ultrasonic beam can be steered by the emitter by selectively connecting determined adjacent pairs of the electrically isolated sections of the emitter to create a plurality of combined emitter sections.

19. The ultrasonic audio system of claim 1, wherein the plurality of electrically isolated sections are arranged as a plurality of concentric annular rings on a face of the emitter.

20. An ultrasonic audio system, comprising:

a location sensor;

a location tracking module configured to receive information from the location sensor and to determine a location of a listener in a listening environment;

a time delay module configured to receive audio content and to generate a plurality of audio content signals, the generated audio content signals comprising a plurality of individual instances of the audio content signal each instance delayed in time relative to the other instances of the audio content signals;

an ultrasonic emitter comprising a plurality of electrically isolated sections, each section having an input electrically coupled to receive one of the individual instances of the audio content signal, and configured to emit an audio-modulated ultrasonic signal from each of the plurality of electrically isolated sections; and a switching matrix configured to selectively route individual ones of the audio content signals to selected groups of electrically isolated sections, wherein the plurality of electrically isolated sections are arranged as a matrix on a face of the emitter, wherein an amount of delay inserted for each instance of the audio content is computed so that a composite audio-modulated ultrasonic signal emitted by the emitter is directed toward the determined location of the listener.

21. An ultrasonic audio system, comprising:

a location sensor;

a location tracking module configured to receive information from the location sensor and to determine respective locations of a plurality of listeners detected by the location sensor;

a time delay module configured to receive audio content and to generate a plurality of audio content signals, the generated plurality of audio content signals each comprising a plurality of individual instances of the audio content signal each instance delayed in time relative to the other instances of its respective audio content signal;

an ultrasonic emitter comprising a plurality of electrically isolated sections, each section having an input electrically coupled to receive one of the individual instances of the audio content signal, and configured to emit an audio-modulated ultrasonic signal from each of the plurality of electrically isolated sections; wherein an amount of delay inserted for the instances of the audio content for each of the generated plurality of audio content signals is computed so that a composite audio-modulated ultrasonic signal emitted by the emitter for each of the generated plurality of audio content signals is directed toward the determined location of respective listener corresponding to that generated audio content signal, wherein the ultrasonic emitter is configured to receive the generated plurality of audio signals multiplexed.

22. The ultrasonic audio system of claim 21, wherein the location tracking module is further configured to track the location of each of the plurality of listeners as the listeners move about in the listening environment, and the time delay module is further configured to adjust the relative delays of the instances of the audio content signal for each listener based on changes in listener positions in the listening environment.

23. The ultrasonic audio system of claim 21, wherein the location sensor comprises an identification-specific sensor.

24. The ultrasonic audio system of claim 23, wherein the identification-specific sensor comprises at least one of an RFID tag, a barcode, an optical identifier, and a facial recognition sensor.

25. The ultrasonic audio system of claim 21, wherein the location sensor comprises a plurality of location sensors.

26. A method of delivering ultrasonic audio using an ultrasonic emitter comprising a plurality of electrically isolated sections, the method comprising:

receiving information, at a location sensor, regarding a location of a user in a listening environment;

receiving information from the location sensor and determining the location of the listener in the listening environment;

generating a plurality of audio content signals, the generated audio content signals comprising a plurality of individual instances of the audio content signal each instance delayed in time relative to the other instances of the audio content signals;

multiplexing the generated plurality of audio content signals prior to delivery to the ultrasonic emitter;

at each of the electrically isolated sections of the ultrasonic emitter: receiving one of the individual instances of the audio content signal and emitting an audio modulated ultrasonic signal;

wherein an amount of delay inserted for each instance of the audio content is determined so that a composite audio-modulated ultrasonic signal emitted by the emitter is directed toward the determined location of the listener.

* * * * *